US008113871B2

(12) United States Patent
Todo et al.

(10) Patent No.: US 8,113,871 B2
(45) Date of Patent: Feb. 14, 2012

(54) CONNECTOR ASSEMBLY

(75) Inventors: Nobuhisa Todo, Tokyo (JP); Akira Ohno, Tokyo (JP); Yuji Hamaoka, Tokyo (JP); Yoshiharu Yamamoto, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 35 days.

(21) Appl. No.: 12/804,328

(22) Filed: Jul. 20, 2010

(65) Prior Publication Data

US 2011/0021058 A1 Jan. 27, 2011

(30) Foreign Application Priority Data

Jul. 22, 2009 (JP) ..... 2009-171594

(51) Int. Cl.
*H01R 3/00* (2006.01)

(52) U.S. Cl. ..... 439/489

(58) Field of Classification Search ..... 439/489, 439/354, 352, 357, 188, 157, 356, 595, 752.5
See application file for complete search history.

(56) References Cited

U.S. PATENT DOCUMENTS

| | | | | |
|---|---|---|---|---|
| 5,131,865 | A * | 7/1992 | Taguchi et al. | 439/489 |
| 5,562,486 | A * | 10/1996 | Saijo et al. | 439/489 |
| 5,667,403 | A * | 9/1997 | Fukuda et al. | 439/489 |
| 5,743,760 | A * | 4/1998 | Inaba et al. | 439/489 |
| 6,257,922 | B1 * | 7/2001 | Shinozaki | 439/489 |
| 6,422,894 | B1 | 7/2002 | Endo et al. | |
| 6,827,596 | B2 * | 12/2004 | Hori | 439/188 |
| 7,140,908 | B2 * | 11/2006 | Katsuma | 439/489 |
| 7,287,993 | B2 * | 10/2007 | Fujii et al. | 439/157 |
| 7,294,015 | B2 * | 11/2007 | Fujii et al. | 439/489 |
| 7,402,071 | B2 * | 7/2008 | Ohtaka et al. | 439/357 |
| 7,445,491 | B2 * | 11/2008 | Fujii et al. | 439/489 |
| 7,559,786 | B2 * | 7/2009 | Glaser et al. | 439/354 |

FOREIGN PATENT DOCUMENTS

| | | |
|---|---|---|
| JP | 8-241761 | 9/1996 |
| JP | 3-666087 | 6/1997 |
| JP | 3-596702 | 10/1997 |
| JP | 3-284200 | 4/2001 |
| JP | 2008-108467 | 5/2008 |

* cited by examiner

*Primary Examiner* — Alexander Gilman
(74) *Attorney, Agent, or Firm* — Collard & Roe, P.C.

(57) ABSTRACT

A connector assembly has a first connector, a second connector matable with the first connector along a mating direction, a mating assistance mechanism, a mating maintenance mechanism, and a detection mechanism. The mating maintenance mechanism includes a stopper, an engagement portion and an elastic support. The engagement portion is configured to be engaged with the stopper in a mating state of the first connector and the second connector so as to maintain the mating state. The detection mechanism is operable to detect the mating state and includes a short-circuit member and first and second terminals having first and second contacting sections, respectively, extending along the mating direction. The short-circuit member is arranged to establish a short circuit between the first terminal and the second terminal in the mating state.

13 Claims, 17 Drawing Sheets

CONNECTOR ASSEMBLY

CROSS REFERENCE TO RELATED APPLICATIONS

Applicants claim priority under 35 U.S.C. §119 of Japanese Patent Application No. JP2009-171594 filed Jul. 22, 2009.

BACKGROUND OF THE INVENTION

The present invention relates to a connector assembly having a mating assistance mechanism using a lever or a slider for mating two connectors with each other, and more particularly to a connector assembly having a detection mechanism operable to accurately detect a mating state of two connectors.

For example, a connector assembly having a detection mechanism operable to detect a mating state of two connectors is disclosed in JP-B 3666087 (Patent Document 1), JP-B 3284200 (Patent Document 2), and JP-A 2008-108467 (Patent Document 3). The connector assembly has a mating maintenance mechanism operable to maintain the mating state of the two connectors. The mating maintenance mechanism includes an engagement portion and a lock arm (elastic support) provided on one of the connectors and a stopper provided on the other connector. When the connectors are mated with each other, the lock arm is momentarily bent and then returned to the original state. At that time, the engagement portion engages with the stopper, so that the mating state of the connectors is maintained. The detection mechanism includes two terminals and a short-circuit member for developing a short circuit between the two terminals. The two terminals are provided on the connector that includes the stopper. The short-circuit member is provided on the lock arm near the engagement portion. When the connectors are mated with each other, the lock arm is momentarily bent and then returned to the original state. At that time, the short-circuit member develops a short circuit between the two terminals, so that a mating state of the connector is detected. However, this connector assembly has no function of wiping contacting portions between the terminals and the short-circuit member. Accordingly, a contact failure may arise due to the contamination of the terminals or the like.

In contrast, JP-B 3596702 (Patent Document 4) and JP-A 8-241761 (Patent Document 5) disclose a connector assembly with a detection mechanism having a wiping function. In either case, the connector assembly has a short-circuit member provided near an engagement portion of a lock arm, and the short-circuit member is brought into contact with terminals in a direction perpendicular to a direction in which the engagement portion supported by the lock arm moves. For example, in a case where the engagement portion moves on the vertical plane parallel to a mating direction, the short-circuit member is brought into contact with the terminals in the horizontal direction. In the connector assembly disclosed in Patent Documents 4 and 5, the width of the short-circuit member in the horizontal direction is set to be greater than the distance between the terminals in the horizontal direction. Thus, when two connectors are mated with each other, the wide short-circuit member is inserted into a narrow space defined between the terminals. Accordingly, the terminals are wiped by the friction produced between the short-circuit member and the terminals.

As in the connector assembly of Patent Document 4 or 5, a considerable insertion force is required to insert a relatively wide short-circuit member into a relatively narrow space between terminals. This insertion force employs a restoring force of the lock arm. When the connector assembly is reduced in size and height, the restoring force of the lock arm may also be reduced. If the restoring force of the lock arm is reduced, it may be impossible to press (or insert) the short-circuit member between the terminals. In such a case, movement of the engagement portion is inhibited, so that the mating maintenance mechanism does not work.

SUMMARY OF THE INVENTION

It is, therefore, an object of the present invention to provide a connector assembly capable of wiping terminals of a detection mechanism without inhibiting a function of a mating maintenance mechanism.

One aspect of the present invention provides a connector assembly which has a first connector, a second connector matable with the first connector along a mating direction, a mating assistance mechanism, a mating maintenance mechanism, and a detection mechanism. The mating assistance mechanism has an operation member and is operable to mate the second connector with the first connector in accordance with an operation of the operation member. The mating maintenance mechanism includes a stopper, an engagement portion and an elastic support. The engagement portion is configured to be engaged with the stopper in a mating state of the first connector and the second connector so as to maintain the mating state. The elastic support is configured to support the engagement portion. The elastic support is elastically deformed and moves the engagement portion along a direction different from the mating direction when the second connector is mated with the first connector. The detection mechanism is operable to detect the mating state and includes a first terminal, a second terminal, and a short-circuit member, The first terminal has a first contacting section extending along the mating direction. The second terminal has a second contacting section extending along the mating direction. The short-circuit member is arranged to establish a short circuit between the first terminal and the second terminal in the mating state. The short-circuit member has a first contact and a second contact which are brought into contact with the first contacting section and the second contacting section in the mating state, respectively. The first contact is directly/indirectly moved by movement and elastic deformation of the elastic support so that the first contact wipes the first contacting section during a mating operation of the first connector and the second connector. The second contact wipes the second contacting section independently of the elastic deformation of the elastic support during the mating operation.

An appreciation of the objectives of the present invention and a more complete understanding of its structure may be had by studying the following description of the preferred embodiment and by referring to the accompanying drawings.

Figure 1:
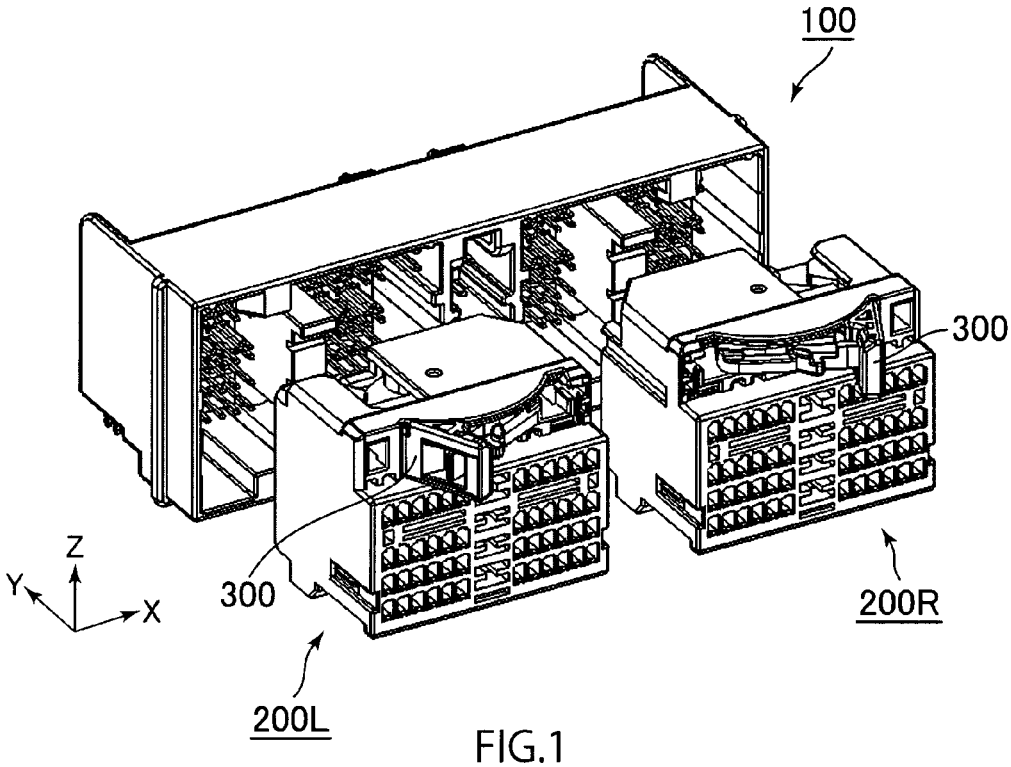
FIG. 1 is a perspective view showing a connector assembly according to a first embodiment of the present invention, in which the connector assembly includes a first connector (male connector) and two second connectors (female connectors).

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

A connector assembly according to embodiments of the present invention will be described below with reference to FIGS. 1 to 35.

Figure 2:
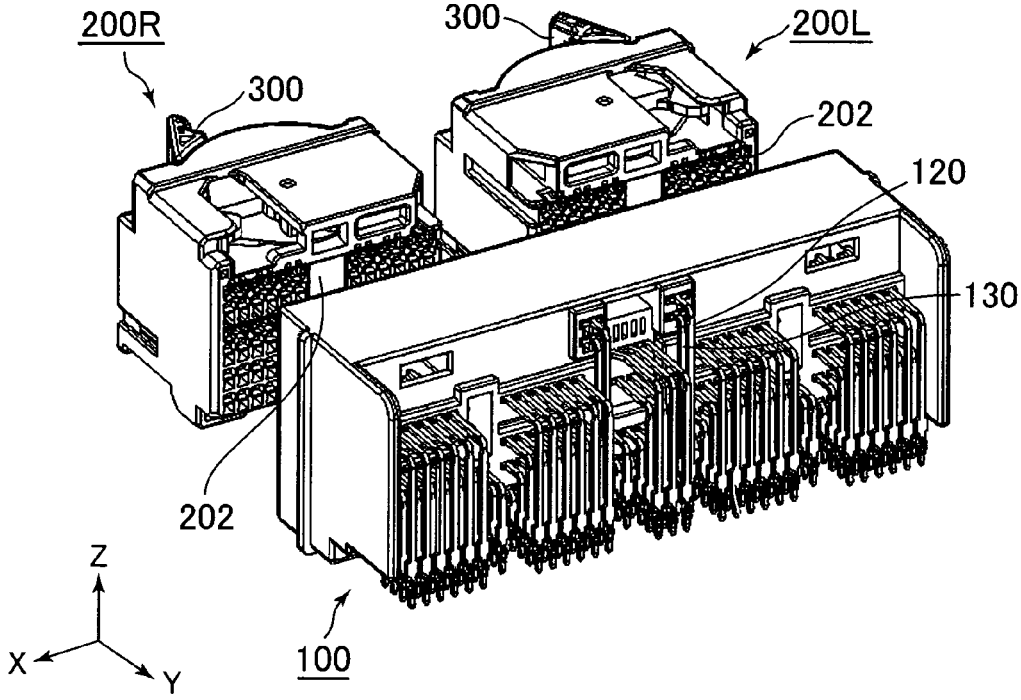
FIG. 2 is a perspective view showing the connector assembly of FIG. 1 as viewed along another direction.

As shown in FIGS. 1 and 2, a connector assembly according to a first embodiment of the present invention includes a first connector 100 and second connectors 200L and 200R matable with the first connector 100 along the Y-direction (mating direction). The connector assembly also includes a mating assistance mechanism operable to mate the second connector 200L or 200R with the first connector 100 in accordance with operation of a lever (operation member) 300, a mating maintenance mechanism operable to regulate movement of the lever 300 in a mating state of the first connector 100 and the second connector 200L or 200R so as to maintain the mating state, and a detection mechanism operable to detect a mating state of the first connector 100 and the second connector 200L or 200R. The connector assembly according to the present embodiment can wipe terminals used for detection in the detection mechanism and can thus conduct self-cleaning. The following description is mainly focused on this wiping function.

Figure 3:
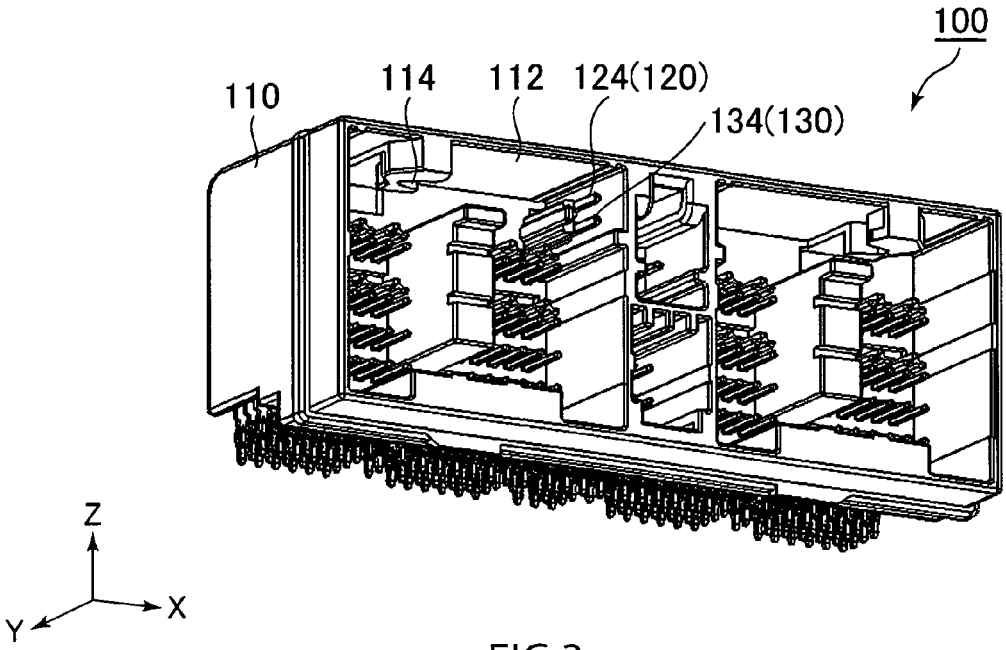
FIG. 3 is a perspective view showing the first connector of FIG. 1.
Figure 4:
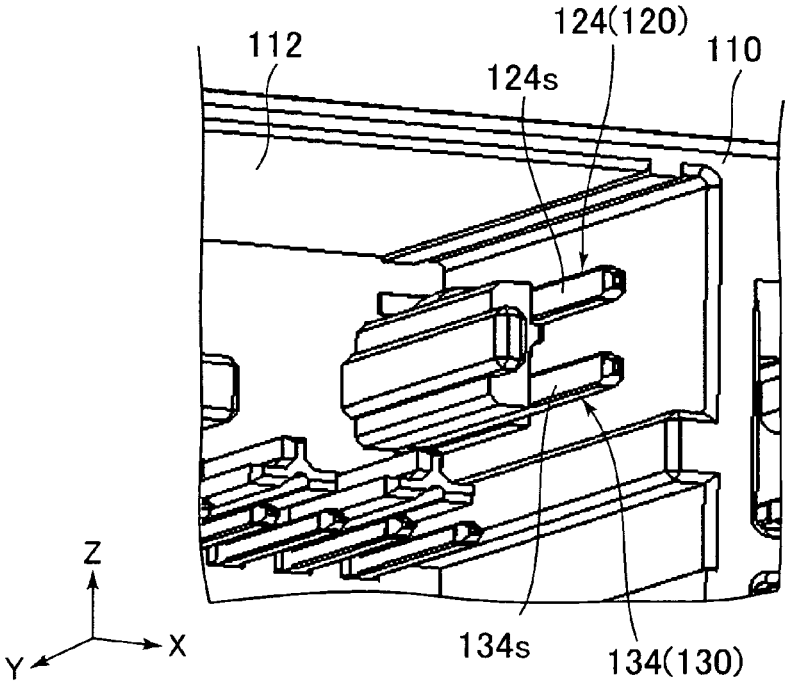
FIG. 4 is an enlarged perspective view showing the vicinity of a first terminal and a second terminal included in the first connector of FIG. 3.

Referring to FIGS. 1 to 3, the first connector 100 includes an insulative housing 110 for holding a number of male terminals, a first terminal 120, and a second terminal 130. The first terminal 120 and the second terminal 130 are held in the housing 110 and used for the detection mechanism. The housing 110 has receptacles 112 formed therein, which respectively receive mating portions 202 of the second connectors 200L and 200R along the Y-direction. A recessed portion 114 used for the mating assistance mechanism is formed in each of the receptacles 112. As shown in FIGS. 3 and 4, the first terminal 120 and the second terminal 130 respectively have a first contacting section 124 and a second contacting section 134 extending along the Y-direction. As shown in FIG. 4, each of the first contacting section 124 and the second contacting section 134 according to the present embodiment has a roughly rectangular cross-section on the XZ-plane. Furthermore, the first contacting section 124 and the second contacting section 134 are arranged in the Z-direction (vertical direction).

Figure 5:
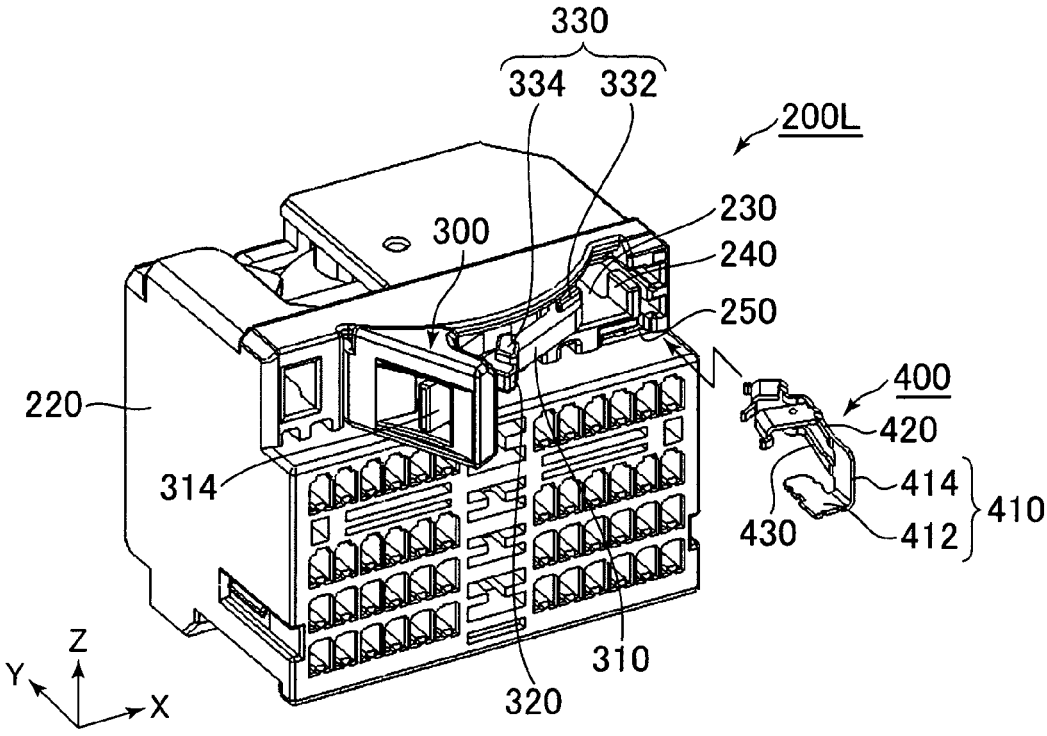
FIG. 5 is a perspective view showing the second connector of FIG. 1, in which a short-circuit member has not been incorporated.
Figure 6:
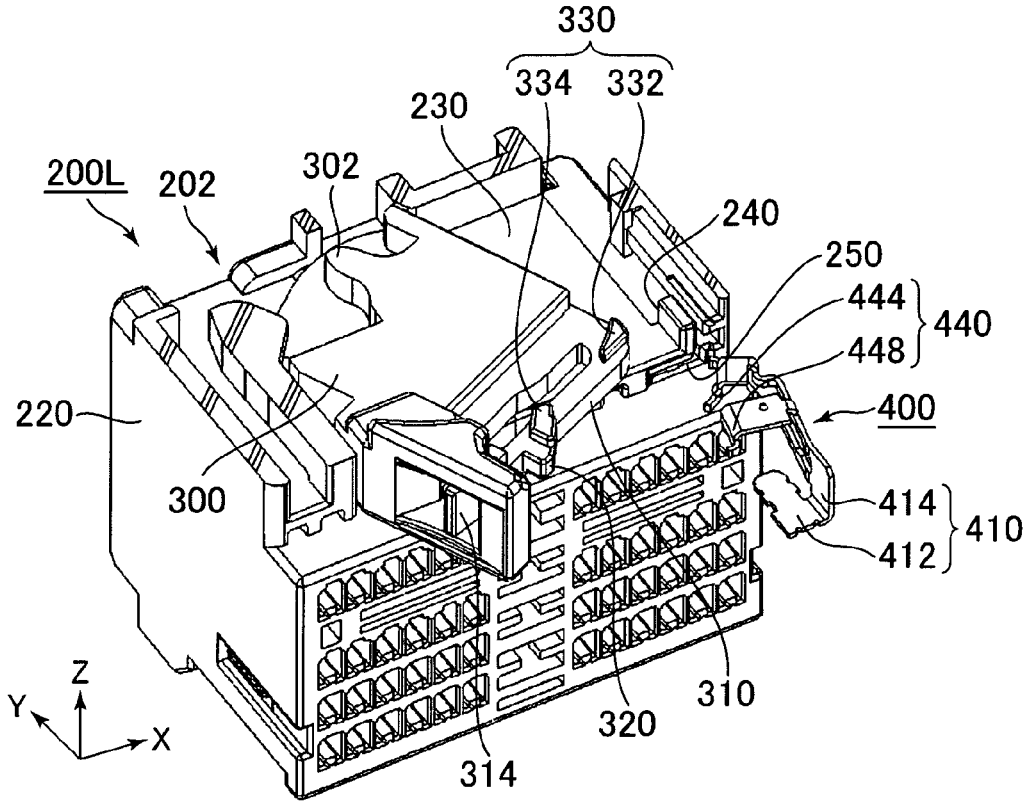
FIG. 6 is a perspective view showing the second connector of FIG. 1 with a partial cross-section.

Referring to FIGS. 5 and 6, the second connector 200L includes an insulative housing 220 for holding a number of female terminals, a lever 300 attached to the housing 220, and a short-circuit member 400 incorporated in the housing 220. The second connector 200R has a structure symmetric to that of the second connector 200L. Therefore, only the second connector 200L will be described in the present embodiment.

Figure 11:
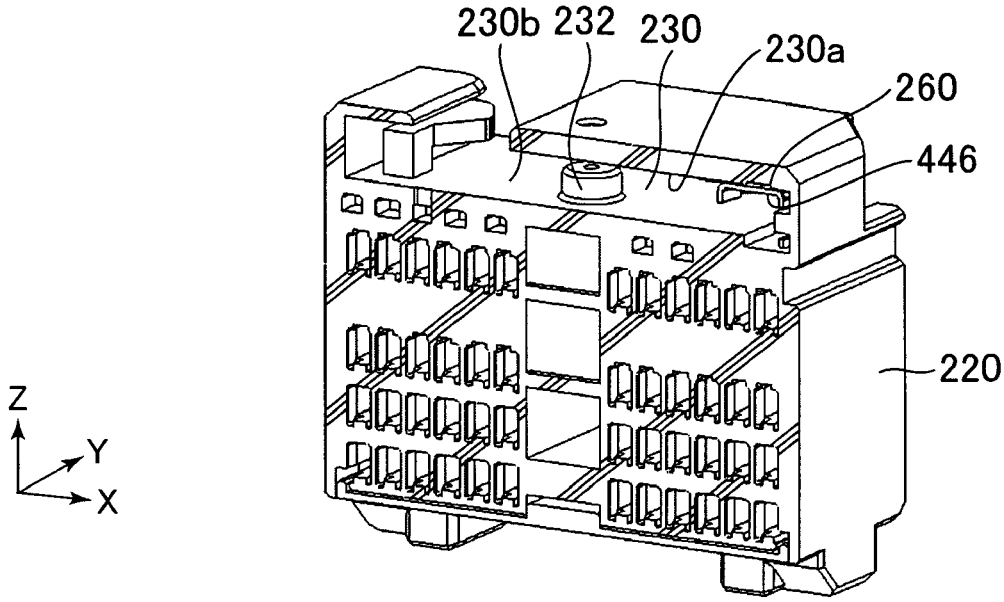
FIG. 11 is a perspective view including a cross-section near a second pressure receiver in the short-circuit member of the second connector of FIG. 5.

As shown in FIGS. 5 and 6, the housing 220 has a lever receptacle 230 for receiving the lever 300, a stopper 240 serving as part of the mating maintenance mechanism, and a holder 250 for holding the short-circuit member 400. As shown in FIG. 11, an axial support 232 is formed in the lever receptacle 230 of this embodiment so as to rotatably support the lever 300. The axial support 232 projects along the Z-direction from a bottom 230*b* of the lever receptacle 230. As shown in FIG. 6, the holder 250 of this embodiment is provided near the stopper 240 so as to permit operation of the short-circuit member 400, which will be described later.

Figure 7:
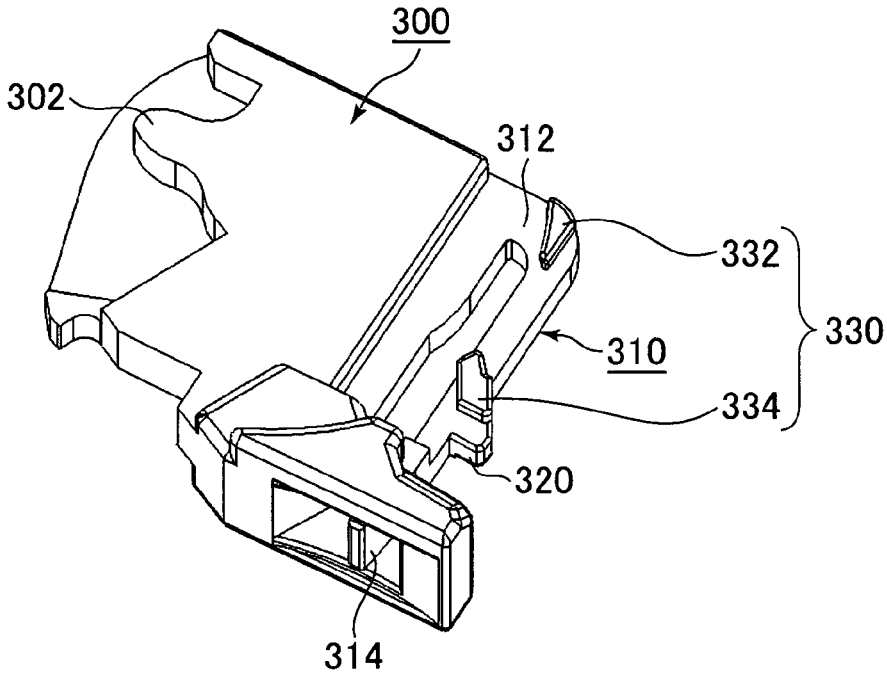
FIG. 7 is a perspective view showing a lever of FIG. 6.

As can be seen from FIGS. 5, 6, and 11, the lever 300 is housed in the lever receptacle 230 and rotatably supported on the axial support 232. Accordingly, the lever 300 can rotate about the axial support 232 on the XY-plane (horizontal plane). As shown in FIGS. 6 and 7, the lever 300 has a protrusion 302, which serves as part of the mating assistance mechanism. The protrusion 302 and the recessed portion 114 of the housing 110 constitute a pinion-rack-based mating assistance mechanism. Specifically, when the lever 300 is rotated in a state in which the second connector 200L or 200R is tentatively mated with the first connector 100, the protrusion 302 of the lever 300 enters the recessed portion 114 of the housing 110 and draws up the housing 110 relative to the second connector 200L or 200R. Thus, the second connector 200L or 200R is firmly mated with the first connector 100.

As shown in FIGS. 6 and 7, a lock arm (elastic support) 310 and an engagement portion 320 are formed on the lever 300 of this embodiment. The lock arm (elastic support) 310 and the engagement portion 320 constitute the mating maintenance mechanism together with the stopper 240 of the housing 220. The lock arm 310 is cantilevered on the lever 300. Specifically, as shown in FIG. 7, the lock arm 310 is formed integrally with the lever 300. The lock arm 310 extends from a base portion 312, at which the lock arm 310 is connected to the lever 300, to an arm operation section 314 as a free end. The lock arm 310 can be bent (i.e., elastically deformed) on the XY-plane by pressure against the engagement portion 320 or operation of the arm operation section 314. The engagement portion 320 extends outward from a position between the base portion 312 and the arm operation section 314 on the XY-plane. The engagement portion 320 is moved on the XY-plane when the lock arm 310 is bent on the XY-plane by operation of the arm operation section 314.

When the lever 300 is rotated, the lock arm 310 is bent (elastically deformed) by abutment of the engagement portion 320 against a side surface of the stopper 240 until the second connector 200L or 200R has been mated with the first connector 100. Once the second connector 200L or 200R has been mated with the first connector 100, the engagement portion 320 moves frontward (toward the mating portion 202) beyond the stopper 240. This movement releases the bending of the lock arm 310 and thereby recovers the state of the lock arm 310. Furthermore, this recovery of the lock arm 310 moves the engagement portion 320 to a position at which the engagement portion 320 can engage with the stopper 240. At that time, the engagement portion 320 is moved in a direction different than the Y-direction (mating direction). The aforementioned configuration of the engagement portion 320 prevents the rotation of the lever 300 in a direction to separate the second connector 200L or 200R from the first connector 100 because the engagement portion 320 engages with the stopper 240. In order to separate the second connector 200L or 200R from the first connector 100, the arm operation section 314 is operated so as to release the engagement of the engagement portion 320 and the stopper 240 and to rotate the lever 300.

As shown in FIG. 7, the lock arm 310 of this embodiment has a presser portion 330 including a first presser 332 and a second presser 334. Specifically, the first presser 332 is provided near the base portion 312, whereas the second presser 334 is provided near the engagement portion 320. In other words, the second presser 334 is located closer to the engagement portion 320 than the first presser 332. Furthermore, each of the first presser 332 and the second presser 334 has an island shape projecting from the lock arm 310 in the Z-direction.

Figure 8:
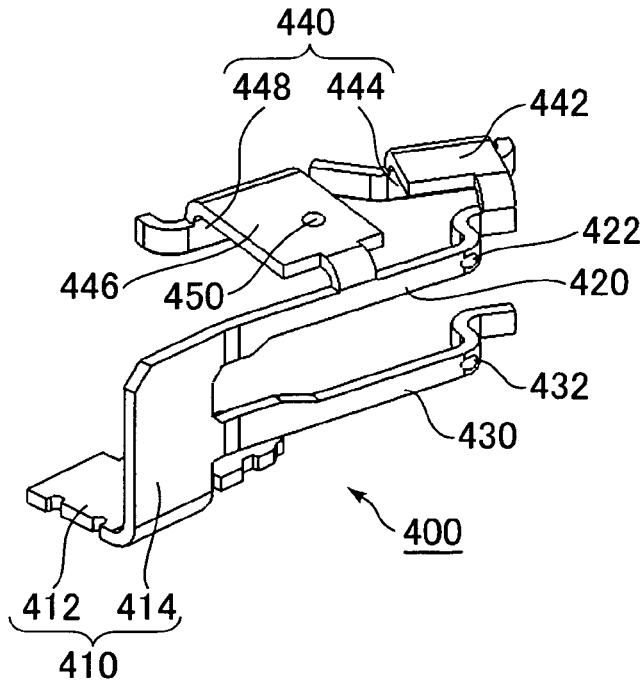
FIG. 8 is a perspective view showing the short-circuit member of FIG. 6.
Figure 9:
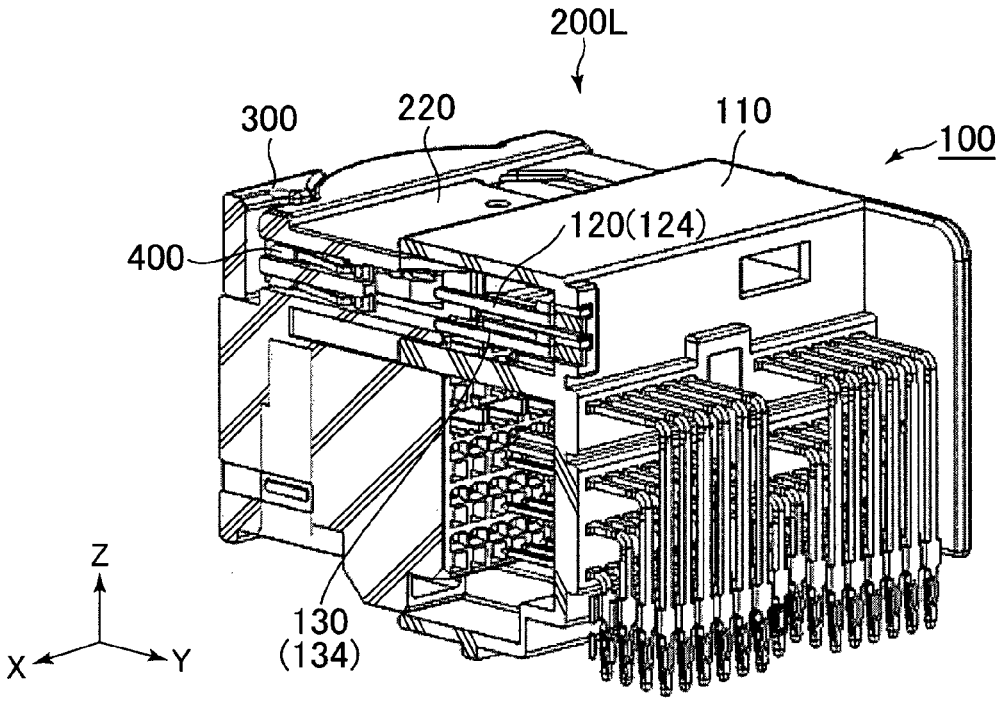
FIG. 9 is a perspective view including a cross-section near the short-circuit member of the connector assembly of FIG. 1, in which the second connector is being mated with the first connector.
Figure 10:
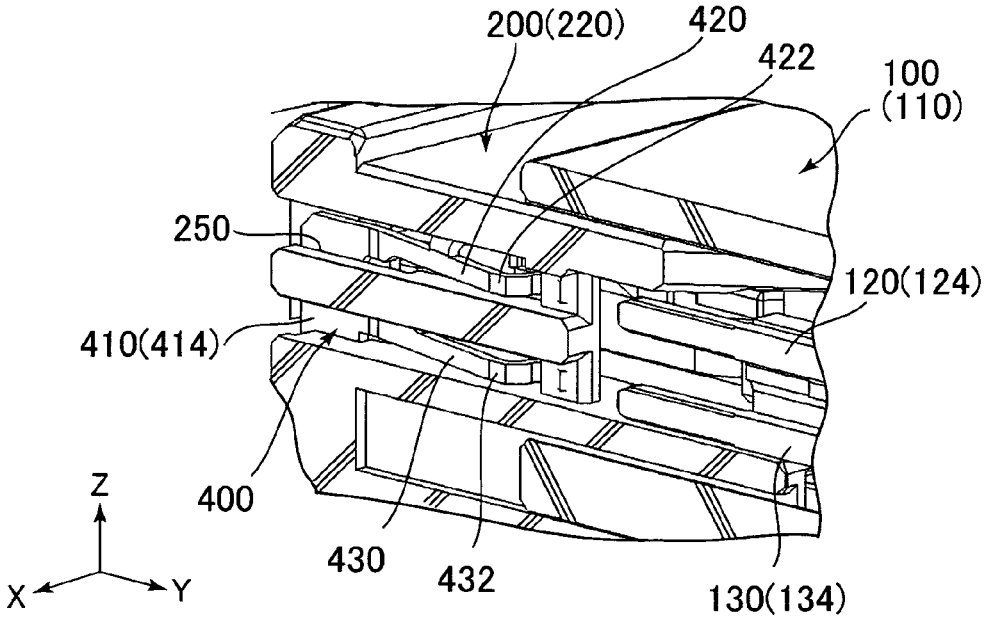
FIG. 10 is an enlarged perspective view including a cross-section near the short-circuit member of the connector assembly of FIG. 1, in which the second connector is being mated with the first connector and is in a state closer to a mating state than that of FIG. 9.

As can be seen from FIG. 10, the short-circuit member 400 of this embodiment is used to develop a short circuit between the first terminal 120 and the second terminal 130 when the first connector 100 and the second connector 200 are mated with each other. Specifically, the first terminal 120, the second terminal 130, and the short-circuit member 400 jointly form a detection mechanism operable to detect a mating state of the first connector 100 and the second connector 200. As shown in FIG. 8, the short-circuit member 400 includes a base portion 410 held by the holder 250 of the housing 220, a first arm 420, and a second arm 430. As shown in FIGS. 6 and 8, the base portion 410 includes a horizontal portion 412 extending parallel to the XY-plane and a vertical portion 414 extending perpendicular to the horizontal portion 412. The short-circuit member 400 is attached to the housing 220 by pressing the horizontal portion 412 into the holder 250. The first arm 420 and the second arm 430 extend roughly along the Y-direction when the short-circuit member 400 has been attached to the housing 220. The first arm 420 has a first contact 422, and the second arm 430 has a second contact 432. The first contact 422 and the second contact 432 are in contact with the first contacting section 124 and the second contacting section 134, respectively, when the first connector 100 and the second connector 200 are mated with each other. The first contact 422 moves according to movement and elastic deformation of the lock arm 310, which will be described in detail later. The second contact 432 moves independently of elastic deformation of the lock arm 310.

The second arm 430 and the second contact 432 will be described in detail. An initial position of the second contact 432 is determined such that the second contact 432 interferes with the second contacting section 134 when the first connector 100 and the second connector 200L are mated with each other. Accordingly, the second contact 432 is slid on the second contacting section 134 when the first connector 100 and the second connector 200L are being mated with each other. Thus, the second contacting section 134 is wiped by the second contact 432. In this embodiment, since the second contact 432 is slid on a side surface 134*s* of the second contacting section 134, it is the side surface 134*s* of the second contacting section 134 that is wiped.

The short-circuit member 400 of this embodiment includes a first support 442 and a second support 446 extending away from the first arm 420 on the XY-plane. The short-circuit member 400 also includes a first pressure receiver 444 elastically supported by the first support 442 and a second pressure receiver 448 elastically supported by the second support 446. As can be seen from FIG. 6, for example, the first support 442 and the first pressure receiver 444 are located closer to the mating portion 202 of the second connector 200L matable with the first connector 100 as compared to the second support 446 and the second pressure receiver 448.

In this embodiment, the first pressure receiver 444 is pressed by the first presser 332, and the second pressure receiver 448 is pressed by the second presser 334. In this embodiment, the first contact 422 is connected to the first pressure receiver 444 and the second pressure receiver 448 via the first support 442, the second support 446, and the first arm 420. Therefore, the first contact 422 is moved when the first pressure receiver 444 or the second pressure receiver 448 is pressed. Pressing of the first pressure receiver 444 and the second pressure receiver 448 by the first presser 332 and the second presser 334 are carried out in cooperation with movement and elastic deformation of the lock arm 310 caused by rotation of the lever 300.

Specifically, the first presser 332 moves the first contact 422 away from the first contacting section 124 during a first period, which is part of operation of rotation of the lever 300. The second presser 334 moves the first contact 422 away from the first contacting section 124 during a second period, which is part of operation of rotation of the lever 300. The second period starts after the first period has started and partially overlaps the first period.

In order to meet such operational conditions, the first presser 332 and the second presser 334 of this embodiment are configured as follows. According to rotation of the lever 300 for mating the second connector 200 with the first connector 100, the first presser 332 passes between the second pressure receiver 448 and the first arm 420, then presses the first pressure receiver 444 on the XY-plane, and moves away from the first pressure receiver 444. Meanwhile, the second presser 334 moves along a path similar to that of the engagement portion 320 and then starts to press the second pressure receiver 448 before the first presser 332 separates from the first pressure receiver 444.

Figure 13:
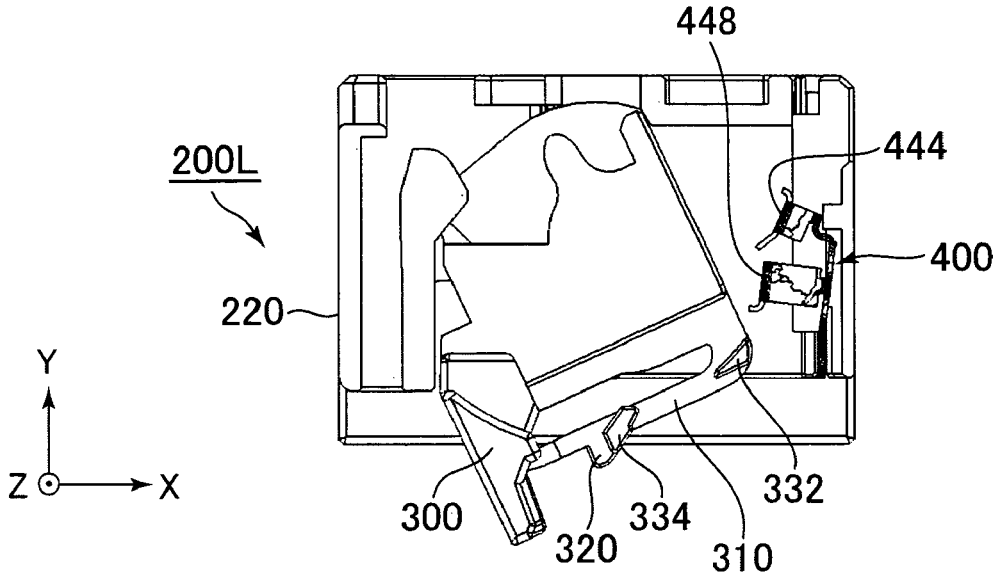
FIG. 13 is a plan view showing rotation of the lever and movement of the short-circuit member.
Figure 14:
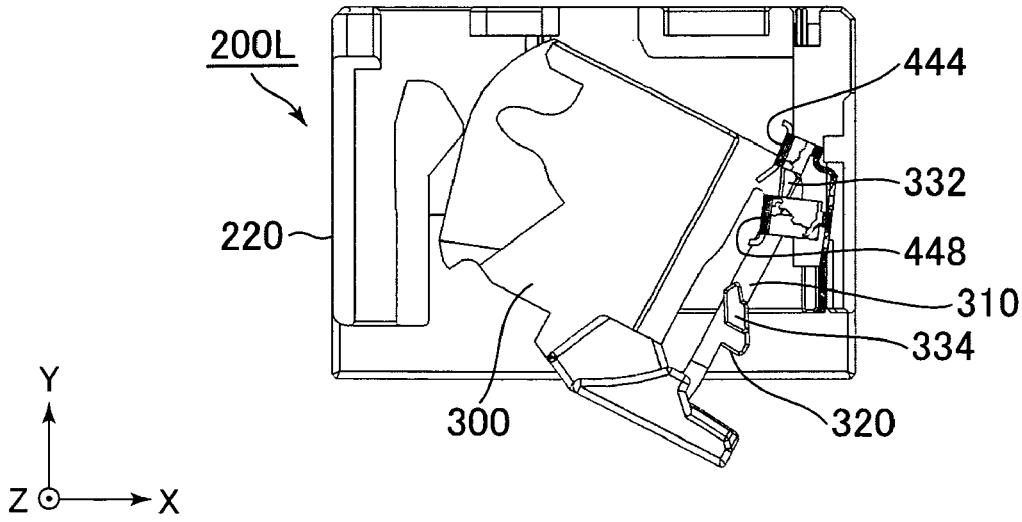
FIG. 14 is another plan view showing rotation of the lever and movement of the short-circuit member.
Figure 15:
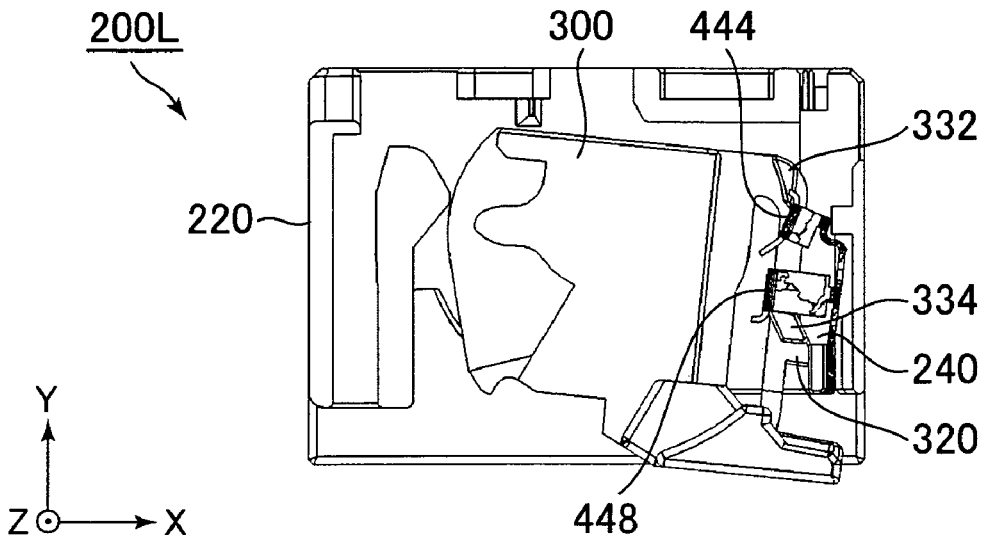
FIG. 15 is another plan view showing rotation of the lever and movement of the short-circuit member.

When the lever 300 is rotated in the state shown in FIG. 13, the first presser 332 first presses the first pressure receiver 444 as shown in FIG. 14. When the lever 300 is further rotated, as can be seen from FIGS. 14 and 15, the second presser 334 presses the second pressure receiver 448 while the first presser 332 presses the first pressure receiver 444. When the lever 300 is further rotated, as shown in FIG. 15, the first presser 332 separates from the first pressure receiver 444, so that the only the second presser 334 presses the second pressure receiver 448. At that time, the first pressure receiver 444 and the second pressure receiver 448 are continuously pressed by at least one of the first presser 332 and the second presser 334. Thus, the first contact 422 has been moved away from the first contacting section 124.

Figure 12:
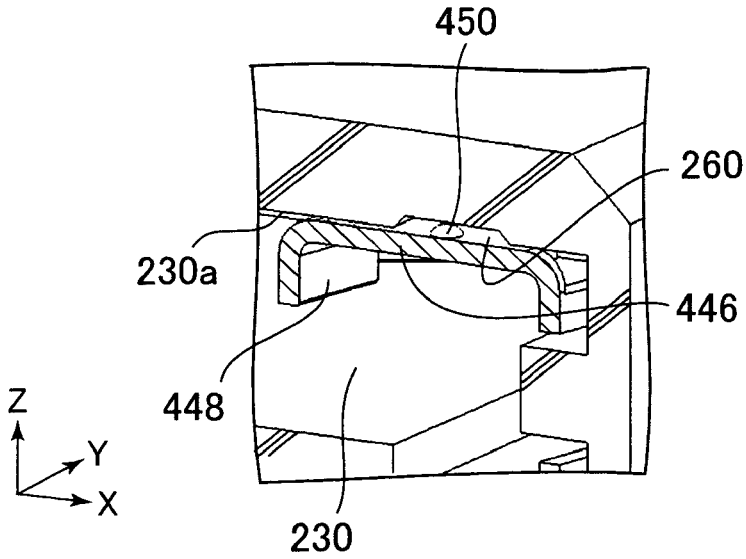
FIG. 12 is an enlarged view showing the second connector of FIG. 11.

Furthermore, as shown in FIG. 8, the second support 446 of this embodiment has a protrusion 450 projecting upward (along the Z-direction). As shown in FIGS. 11 and 12, the protrusion 450 is located within the recessed portion 260 formed in an upper surface 230*a* of the lever receptacle 230 when the first contact 422 is located at a position at which the first contact 422 can be brought into contact with the first contacting section 124. The protrusion 450 is moved outside of the recessed portion 260 when the first contact 422 is moved away from the first contacting section 124. When the second pressure receiver 448 is pressed by the second presser 334 so that the protrusion 450 is moved outside of the recessed portion 260, the second support 446 is lowered by a step difference between the recessed portion 260 and the upper surface 230*a* of the lever receptacle 230. The second presser 448 and the first contact 422 are accordingly lowered. The upper surface 230*a* of the lever receptacle 230, the recessed portion 260 formed in the upper surface 230*a*, and the protrusion 450 provided on the second support 446 jointly serve as a movement mechanism operable to temporarily move the second pressure receiver 448 in the Z-direction until the engagement portion 320 engages with the stopper 240 while the second presser 334 presses the second pressure receiver 448.

Figure 16:
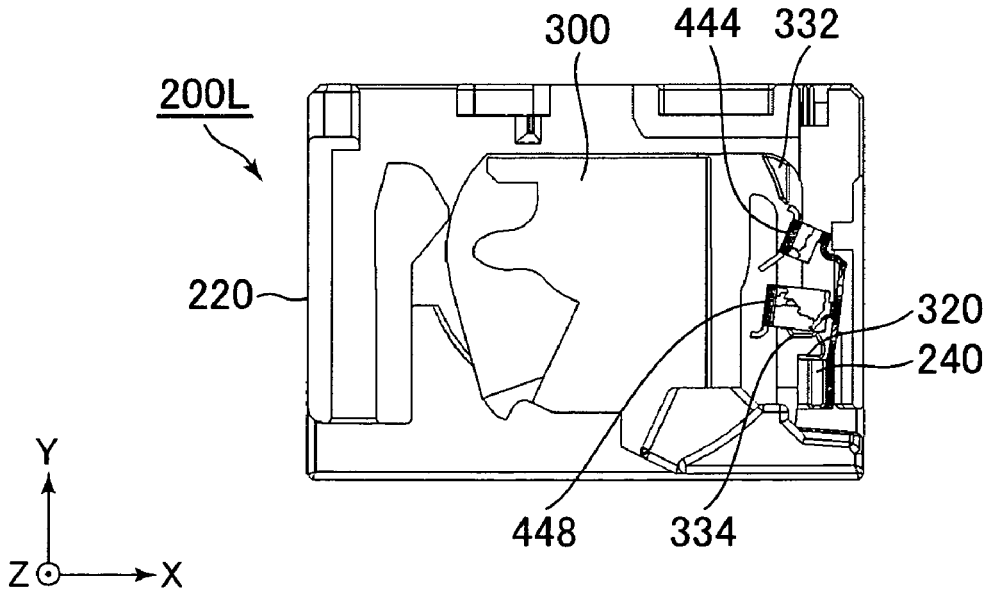
FIG. 16 is another plan view showing rotation of the lever and movement of the short-circuit member.

When the lever 300 is rotated in a state in which the second pressure receiver 448 is pressed only by the second presser 334, the engagement portion 320 is slid on a side surface of the stopper 240 and moved beyond the stopper 240 in the Y-direction. Then, as shown in FIG. 16, the engagement portion 320 is moved to the front of the stopper 240 by a restoring force of the lock arm 310. That is, the engagement portion 320 and the second presser 334 provided near the engagement portion 320 are moved in the X-direction (horizontal direction). At that time, the pressure applied to the second pressure receiver 448 by the second presser 334 is eliminated so that the first contact 422 is returned to the initial position by a restoring force of the first arm 420. Here, the first contacting section 124 is present at a position corresponding to the initial position of the first contact 422 in the mating state of the first connector 100 and the second connector 200L. Therefore, when the first contact 422 is returned to the initial position by the restoring force of the first arm 420, it is brought into contact with the first contacting section 124. In this case, the distance of the movement of the first contact 422 in the Z-direction by the movement mechanism is simultaneously recovered. Specifically, the first contact 422 is returned to its initial position in the Z-direction. Thus, the first contact 422 is also moved in the Z-direction. Therefore, the first contacting section 124 is wiped along the Z-direction by the first contact 422. At that time, since the first contact 422 is brought into contact with a side surface 124*s* of the first contacting section 124, it is the side surface 124*s* of the first contacting section 124 that is wiped.

As described above, when the second connector 200 is mated with the first connector 100, the second contact 432 is slid on the second contacting section 134 and is thus electrically connected to the second contacting section 134. On the other hand, the first contact 422 is not connected to the first contacting section 124 until the second connector 200 has been mated with the first connector 100. In other words, the first contact 422 is electrically connected to the first contacting section 124 only when the second connector 200 has been mated with the first connector 100. Accordingly, the short-circuit member 400 develops a short circuit between the first terminal 120 and the second terminal 130 only when the second connector 200 has been mated with the first connector 100. Therefore, a mating state can be detected by monitoring a state of the first terminal 120 and the second terminal 130.

As described above, in the connector assembly of this embodiment, the first pressure receiver 444 and the second pressure receiver 448 are respectively pressed by the first presser 332 and the second presser 334 in cooperation with movement and elastic deformation of the lock arm 310. When the pressure receiver portion 440 (the first pressure receiver 444 and the second pressure receiver 448) is thus pressed by the presser portion 330 (the first presser 332 and the second presser 334), the first contact 422 wipes the first contacting section 124. Meanwhile, no pressure receiver portion 440 is provided on the second arm 430 on which the second contact 432 is provided. Therefore, the second contact 432 wipes the second contacting section 134 not depending upon movement and elastic deformation of the lock arm 310, but depending upon the mating state of the second connector 200L with the first connector 100. Thus, according to the present embodiment, movements of the two contacts of the short-circuit member 400 are controlled by different methods. Therefore, the wide short-circuit member does not need to be inserted into a narrow space between the terminals, unlike Patent Documents 4 and 5. Accordingly, the first terminal 120 (the first contacting section 124) and the second terminal 130 (the second contacting section 134) of the detection mechanism can reliably be wiped without inhibiting functions of the mating maintenance mechanism.

Particularly, in a case of a connector assembly in which the lock arm 310 is bent on the horizontal plane, an increase of the size of the connector is prevented by separating the presser portion 330 into two elements including the first presser 332 and the second presser 334, similarly separating the pressure receiver portion 440 into two elements including the first pressure receiver 444 and the second pressure receiver 448, and moving the first contact 422 through cooperation of those elements.

A connector assembly according to a second embodiment of the present invention will be described with reference to FIGS. 17 to 24. In the first embodiment, the lock arm is bent on the horizontal plane. In other words, the engagement portion is moved on the horizontal plane. In the present embodiment, however, the lock arm is bent on the vertical plane as with Patent Document 3. In other words, the engagement portion is moved on the vertical plane. The following description is mainly focused on the detection mechanism. The detailed explanation of the mating assistance mechanism and the mating maintenance mechanism will be omitted herein. The mating assistance mechanism and the mating maintenance mechanism of this embodiment are basically the same as those of Patent Document 3.

Figure 17:
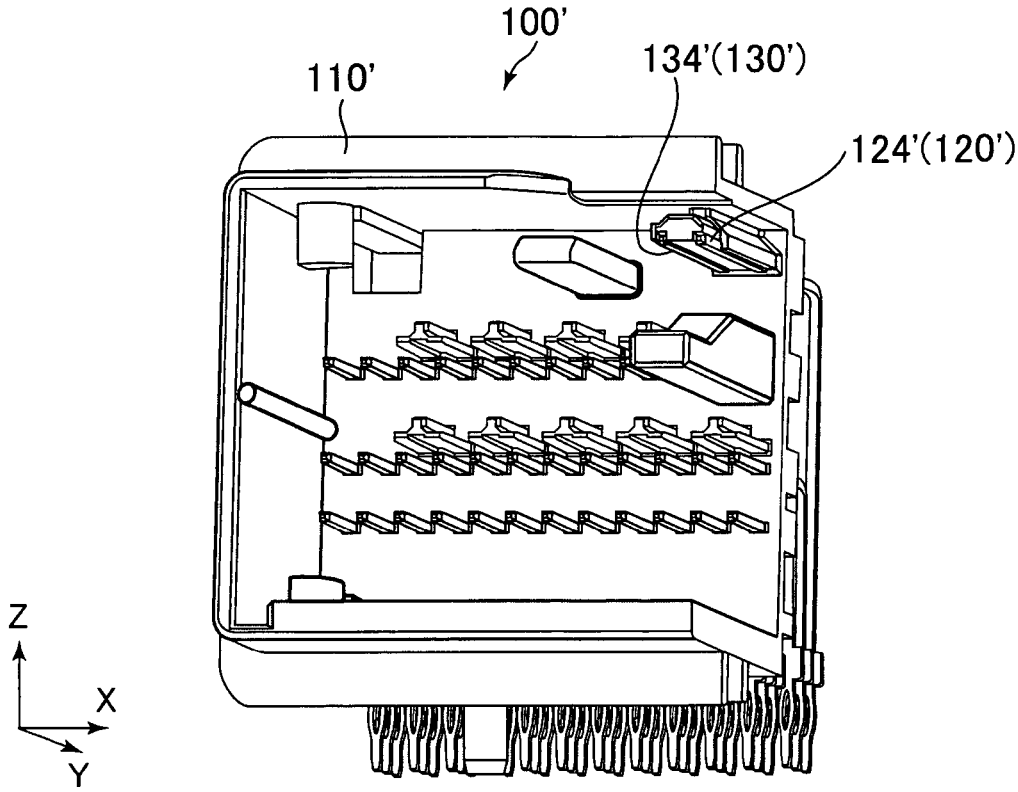
FIG. 17 is a perspective view showing part of a first connector included in a connector assembly according to a second embodiment of the present invention.
Figure 18:
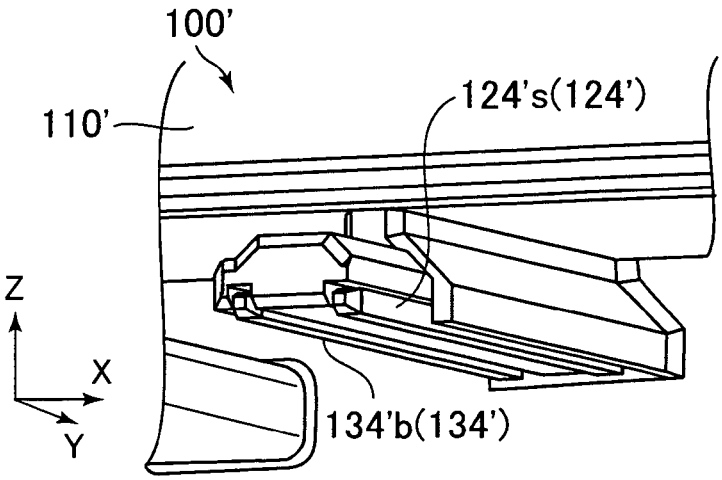
FIG. 18 is an enlarged perspective view showing the vicinity of a first terminal and a second terminal provided on the first connector of FIG. 17.

Referring to FIGS. 17 and 18, a first connector 100' includes an insulative housing 110' for holding a number of male terminals, a first terminal 120', and a second terminal 130'. The first terminal 120' and the second terminal 130' are held in the housing 110' and used for the detection mechanism. As shown in FIG. 18, the first terminal 120' and the second terminal 130' respectively have a first contacting section 124' and a second contacting section 134' extending along the Y-direction. Each of the first contacting section 124' and the second contacting section 134' according to the present embodiment has a roughly rectangular cross-section on the XZ-plane. Furthermore, the first contacting section 124' and the second contacting section 134' are arranged in the X-direction. Particularly, the first contacting section 124' is held on the housing 110' so that a side surface 124'*s* is exposed. The second contacting section 134' of this embodiment is held on the housing 110' so that only a lower surface 134'*b* is exposed.

Figure 19:
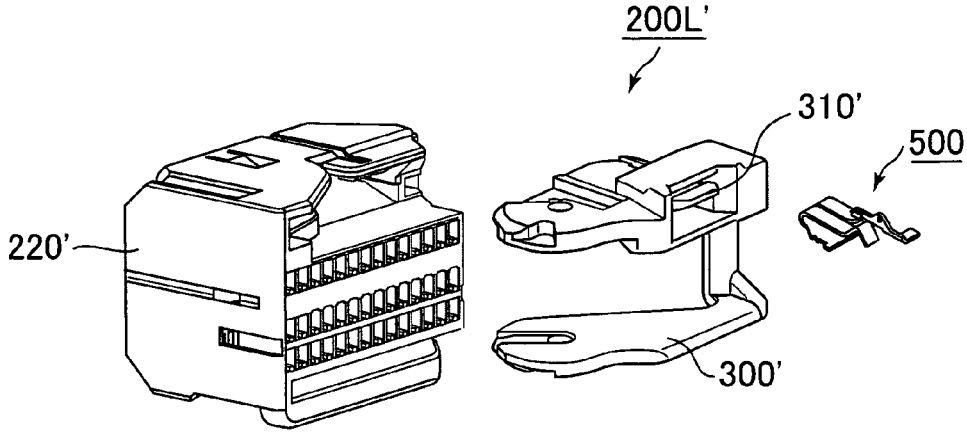
FIG. 19 is an exploded perspective view showing a second connector included in the connector assembly according to the second embodiment of the present invention.

Referring to FIG. 19, a second connector 200L' includes an insulative housing 220' for holding a number of female terminals, a lever 300' attached to the housing 220', and a short-circuit member 500 incorporated in the housing 220'. The lever 300' serves as an operation member of the mating assistance mechanism. The lever 300' is held on the housing 220' so as to be rotatable on the horizontal plane as with the first embodiment. As can be seen from FIGS. 19 and 23, a lock arm 310' is formed integrally with the lever 300' and can be bent on the vertical plane. Therefore, a projecting engagement portion 320' provided on the lock arm 310' is also movable on the vertical plane. When the engagement portion 320' of the lock arm 310' engages with a stopper (not shown) provided on the housing 220', the lever 300' is fixed so that a mating state of the first connector 100' and the second connector 200L' is maintained.

Figure 20:
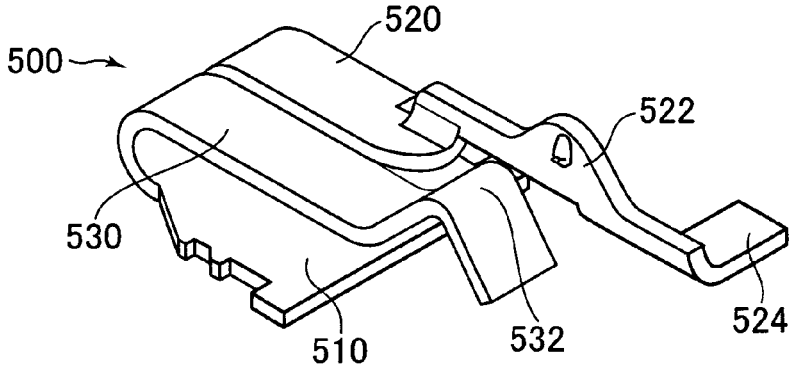
FIG. 20 is a perspective view showing a short-circuit member of the second connector of FIG. 19.
Figure 21:
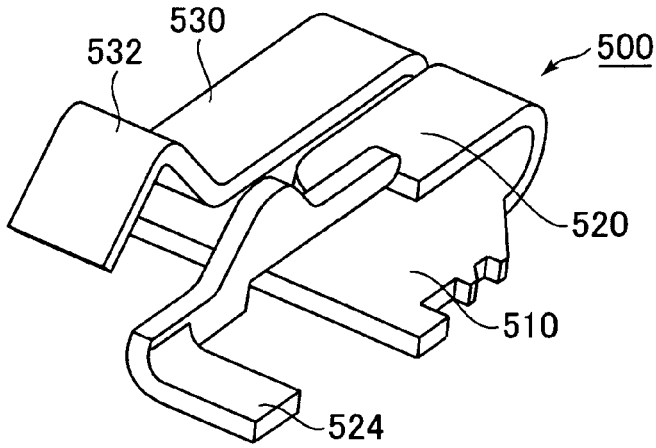
FIG. 21 is a perspective view showing the short-circuit member of FIG. 20 as viewed along another direction.
Figure 22:
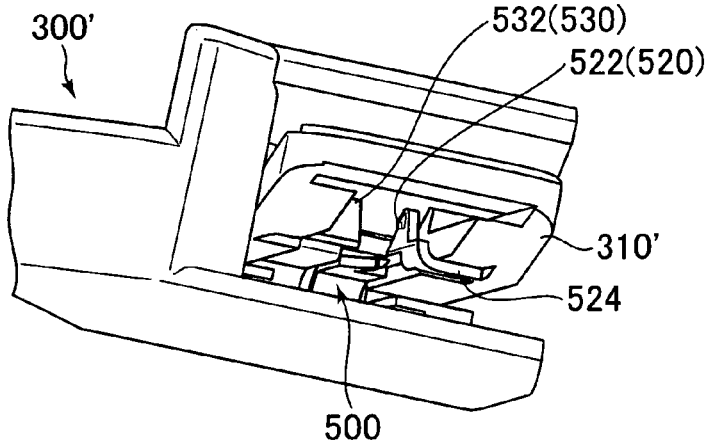
FIG. 22 is an enlarged perspective view partially showing a state in which the short-circuit member has been incorporated in a lever of the second connector of FIG. 19.
Figure 23:
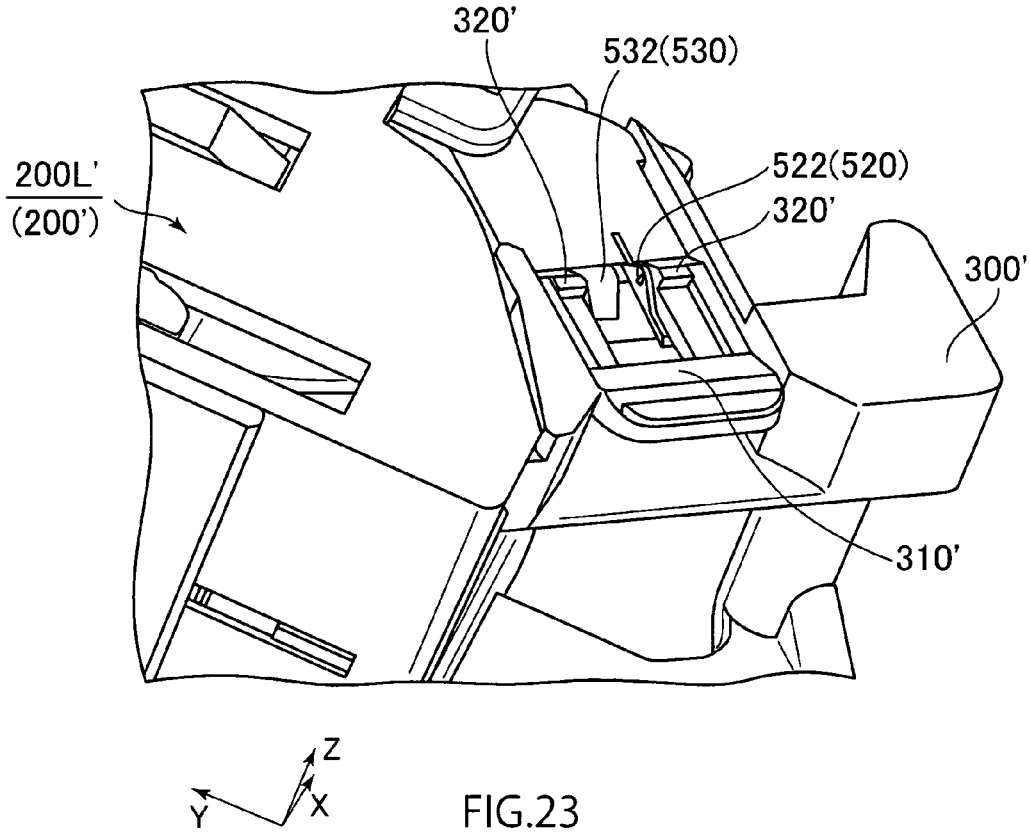
FIG. 23 is an enlarged perspective view showing part of the second connector of FIG. 19, in which the short-circuit member has been attached to the lever. The lever has been incorporated in a housing and is the most widely opened.
Figure 24:
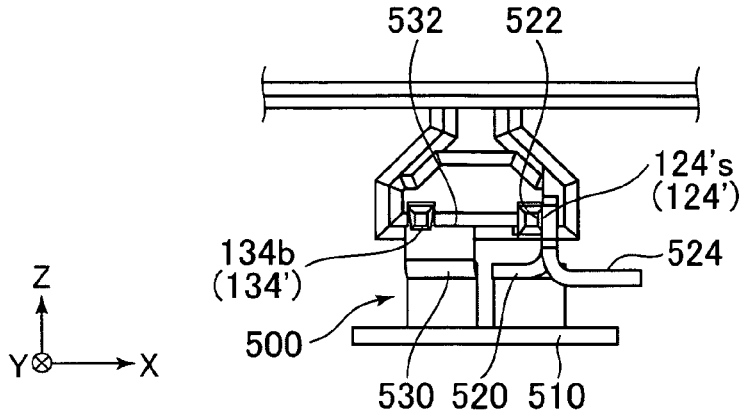
FIG. 24 is a view showing the first terminal, the second terminal, and the short-circuit member as viewed from a rear side of the second connector. A short circuit has been developed between the first terminal and the second terminal by the short-circuit member.

Referring to FIGS. 20 and 21, the short-circuit member 500 of this embodiment includes a base portion 510 pressed in and held by the housing 220', a first arm 520, and a second arm 530. As shown in FIGS. 19, 22, and 23, the short-circuit member 500 is attached to the lever 300'. As shown in FIGS. 20 and 21, the first arm 520 includes a first contact 522 extending along the horizontal direction from a portion that is parallel to the vertical plane and a pressure receiver 524 that can be pushed downward by the lock arm 310'. The second arm 530 includes a second contact 532 projecting in the vertical direction. Specifically, the first contact 522 is elastically supported on the first arm 520, and the second contact 532 is elastically supported on the second arm 530. As can be seen from FIGS. 20 to 23, the second arm 530 has no pressure receiver 524 unlike the first arm 520. Accordingly, while the first contact 522 of the first arm 520 is moved in cooperation with movement of the lock arm 310', the second contact 532 of the second arm 530 is moved independently of elastic deformation of the lock arm 310'. Furthermore, when the first connector 100' and the second connector 200L' are mated with each other, as shown in FIG. 24, the first contact 522 is in contact with the side surface 124'*s* of the first contacting section 124' while the second contact 532 is in contact with the lower surface 134'*b* of the second contacting section 134'.

With the above configuration, the second contact 532 is slid on the lower surface 134'*b* of the second contacting section 134' by operation of closing the lever 300'. Thus, the second contact 532 can wipe the lower surface 134'*b* of the second contacting section 134'. The first contact 522 can wipe the side surface 124'*s* of the first contacting section 124' along the Z-direction with deformation and recovery of the lock arm 310'.

A connector assembly according to a third embodiment of the present invention will be described with reference to FIGS. 25 to 35. In the first and second embodiments, the lever is used as an operation member of the mating assistance mechanism. In the present embodiment, however, a slider 600 is used as an operation member as shown in FIGS. 25 and 26.

Figure 25:
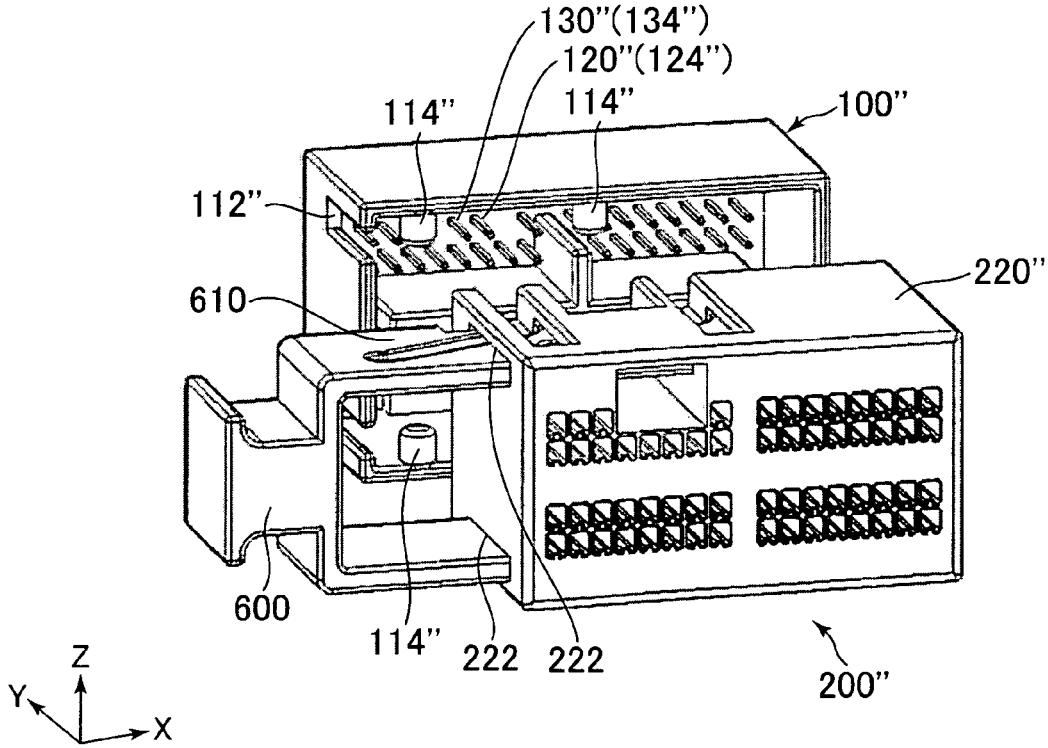
FIG. 25 is a perspective view showing a connector assembly according to a third embodiment of the present invention, in which the connector assembly includes a first connector and a second connector having a slider.
Figure 26:
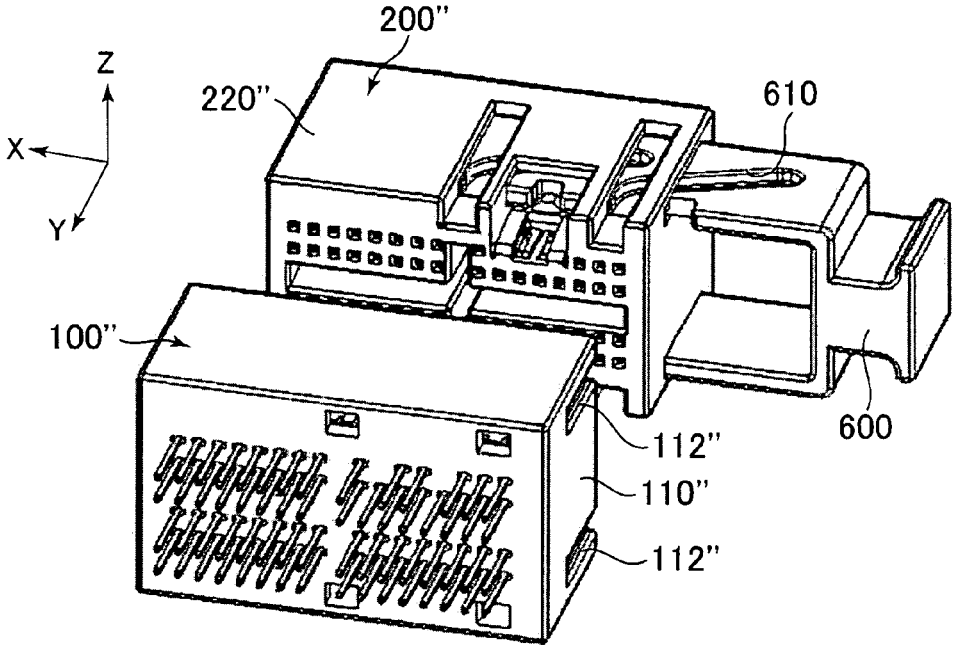
FIG. 26 is a perspective view showing the connector assembly of FIG. 25 as viewed along another direction.
Figure 29:
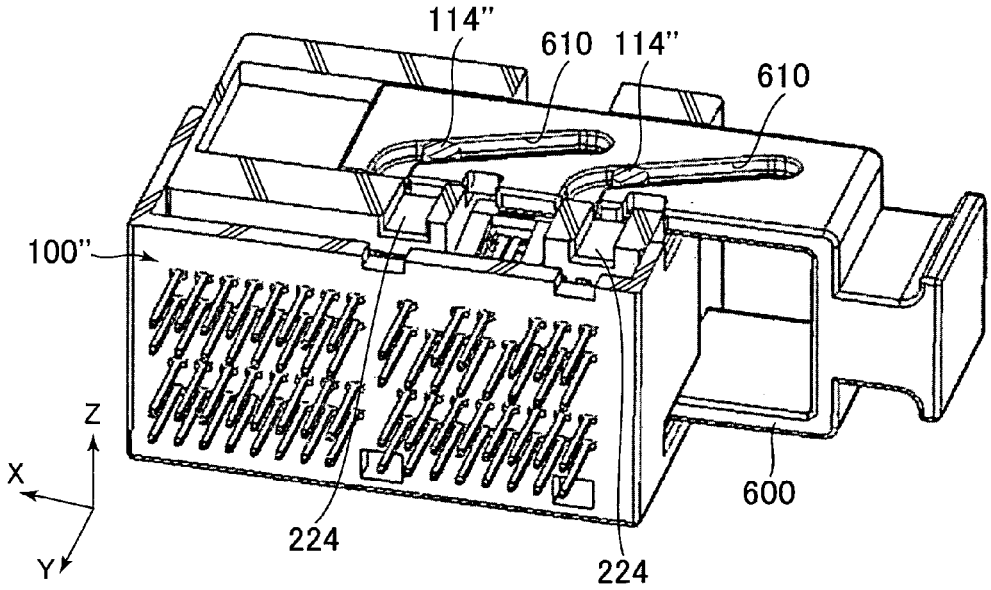
FIG. 29 is a perspective view including a cross-section near an upper surface of the slider in the connector assembly of FIG. 26.
Figure 35:
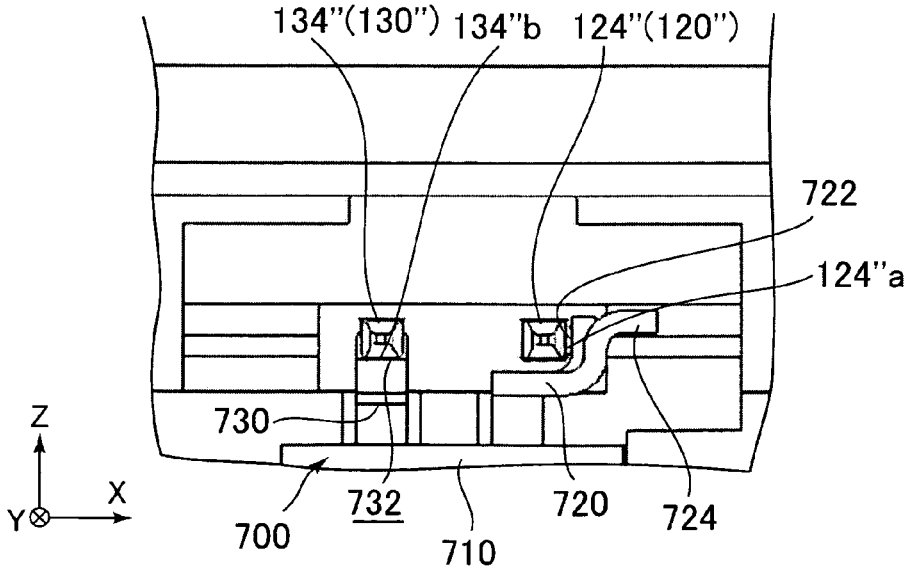
FIG. 35 is a view showing a first terminal, a second terminal, and the short-circuit member as viewed from a rear side of the second connector. A short circuit has been developed between the first terminal and the second terminal by the short-circuit member.

Referring to FIGS. 25, 26, and 29, a first connector 100" includes an insulative housing 110" for holding a number of male terminals, a first terminal 120", and a second terminal 130". The first terminal 120" and the second terminal 130" are held in the housing 110" and used for the detection mechanism. The housing 110" has a side surface with slits 112" that can receive the slider 600. Guide projections 114" are formed so as to project inward from upper and lower surfaces of the housing 110". As shown in FIG. 25, the first terminal 120" and the second terminal 130" respectively have a first contacting section 124" and a second contacting section 134" extending along the Y-direction. As shown in FIG. 35, each of the first contacting section 124" and the second contacting section 134" according to the present embodiment has a roughly rectangular cross-section on the XZ-plane. Furthermore, the first contacting section 124" and the second contacting section 134" are arranged in the X-direction.

Referring to FIGS. 25 to 28, a second connector 200" includes an insulative housing 220" for holding a number of female terminals, the slider 600 slidably held in the housing 220", and a short-circuit member 700 incorporated in the housing 220".

Figure 27:
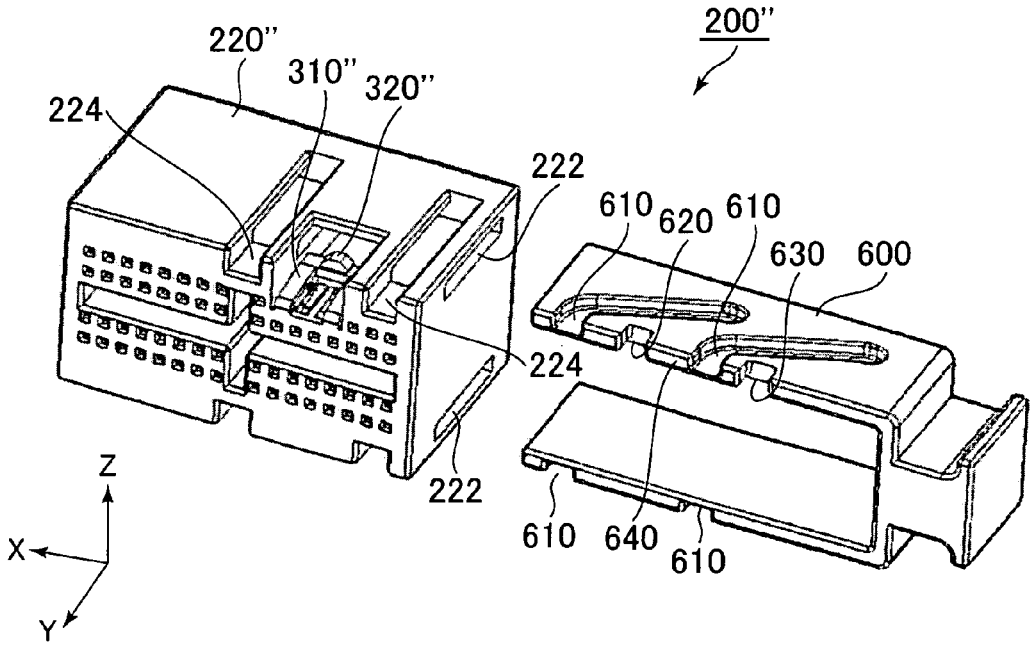
FIG. 27 is an exploded perspective view showing the second connector of FIG. 26.
Figure 28:
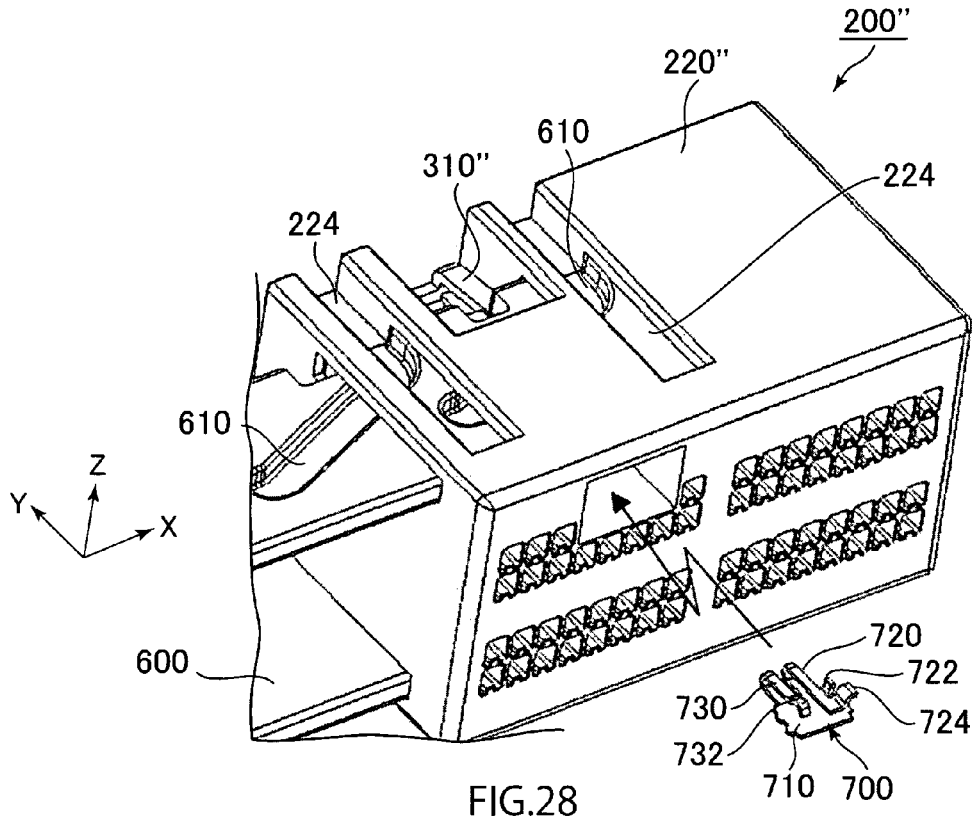
FIG. 28 is an enlarged perspective view showing the connector assembly of FIG. 25.

As shown in FIGS. 27 and 28, the housing 220" has slots 222 in which the slider 600 can be inserted, guide portions 224 that can guide the guide projections 114" of the first connector 100", and a lock arm 310". As can be seen from FIGS. 27 and 29, the slots 222 are formed in a side surface of the housing 220". The slots 222 communicate with a slider insertion spaces extending along the X-direction. There are two slots 222 of an upper slot and a lower slot. The guide portions 224 are defined by grooves extending along the Y-direction. The size of the guide portions 224 in the X-direction is set to be slightly larger than that of the guide projections 114" of the first connector 100". The guide portions 224 communicate with the aforementioned slider insertion spaces. As shown in FIG. 27, the lock arm 310" elastically supports the engagement portion 320" so that the engagement portion 320" is movable along the Z-direction. As can be seen from comparison of FIG. 27 and FIG. 29, the engagement portion 320" is located in the slider insertion space. The engagement portion 320" has a roughly mountainous shape on the XZ-plane. Therefore, when the slider 600 is moved along the X-direction and brought into contact with the engagement portion 320", the slider 600 can push the engagement portion 320" downward.

Referring to FIGS. 27 and 29, the slider 600 has a portion having a hook-shape as viewed along the Y-direction. The hook-shape of the slider 600 includes an upper portion having a rectangular shape and a lower portion having a rectangular shape. The upper portion and the lower portion are opposed to each other in the Z-direction. Two cam portions 610 are formed in each of the upper portion and the lower portion. The cam portions 610 of this embodiment are defined by grooves extending along the Y-direction from edges of the upper portion and the lower portion and then extending along a direction that is oblique to both of the X-direction and the Y-direction. When the slider 600 is moved along the X-direction, the guide projections 114" of the first connector 100" are moved along the Y-direction by the cam portions 610 and the guide portions 224. Thus, when the slider 600 is pushed along the X-direction in a state in which the second connector 200" is tentatively mated with the first connector 100", then the guide projections 114" are guided along the Y-direction (toward the negative Y-direction), so that the second connector 200" can firmly be mated with the first connector 100". Thus, in the present embodiment, the slider 600 and the guide projections 114" of the first connector 100" serve as a mating assistance mechanism. As described above, the slider 600 serves as an operation member.

The slider 600 has two notches of a first notch 620 and a second notch 630. The first notch 620 is located between the two cam portions 610. The second notch 630 is located outside of the two cam portions 610.

Figure 30:
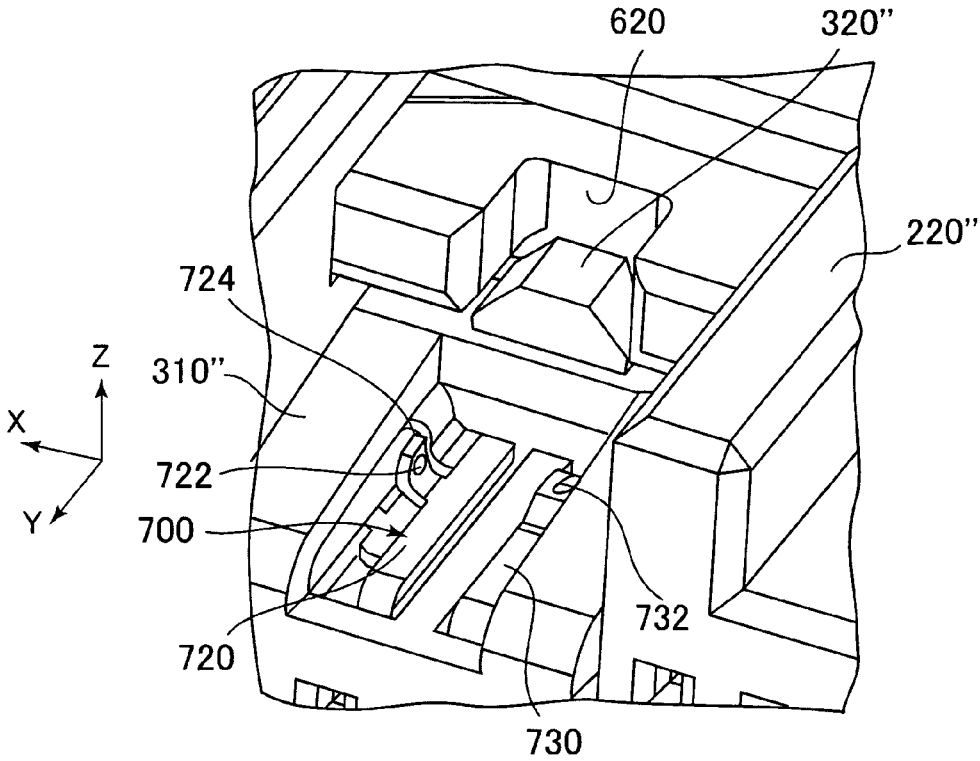
FIG. 30 is an enlarged perspective view showing the vicinity of a lock arm provided on the second connector of FIG. 26. An engagement portion supported by the lock arm is positioned within a recessed portion formed in the slider and is located at an initial vertical position in a vertical direction.
Figure 31:
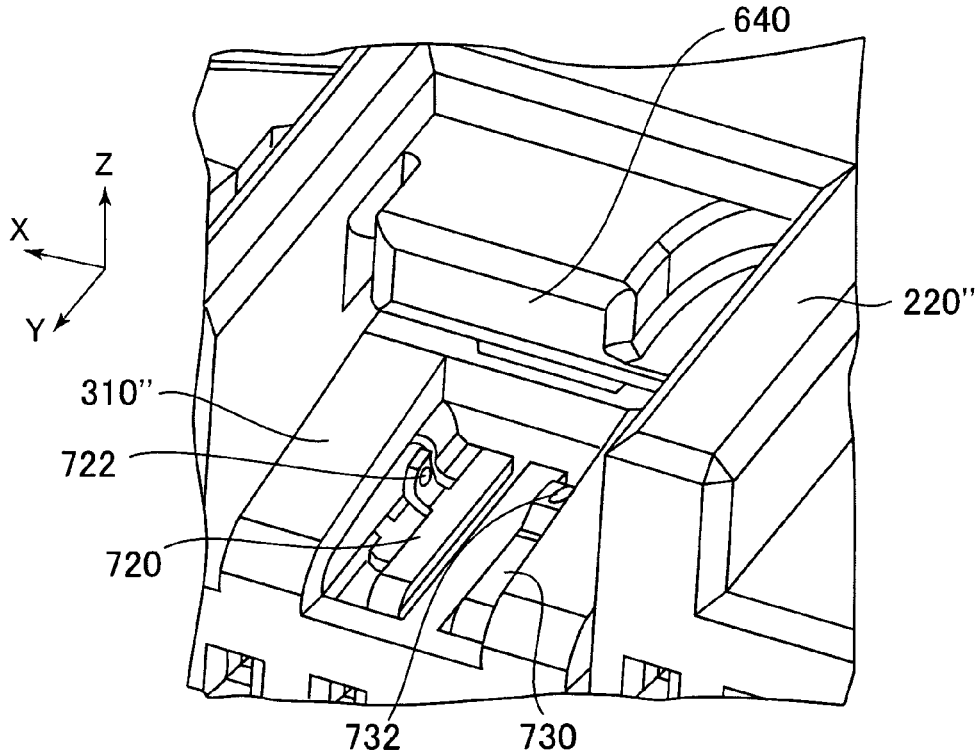
FIG. 31 is an enlarged perspective view showing the vicinity of the lock arm of FIG. 30. The engagement portion supported by the lock arm has been pushed downward by the slider.
Figure 32:
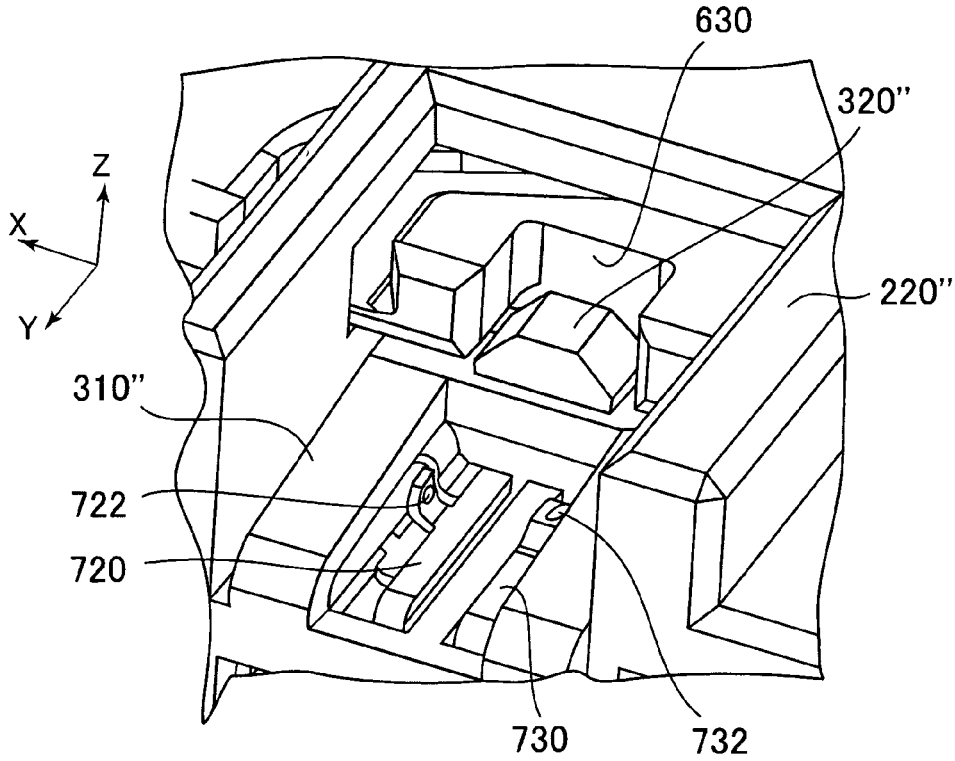
FIG. 32 is another enlarged perspective view showing the vicinity of the lock arm of FIG. 30. The engagement portion supported by the lock arm is positioned within another recessed portion formed in the slider and has been returned to the initial vertical position in the vertical direction.

The first notch 620 is configured such that the guide portions 224 communicate with entries of the cam portions 610 when the engagement portion 320" is positioned within the first notch 620 (see FIGS. 26 and 28). Specifically, as shown in FIG. 30, when the engagement portion 320" is positioned within the first notch 620, the slider 600 is positioned at an initial position. If the slider 600 is pushed into the housing 220" from the initial position along the X-direction, then the engagement portion 320" is pushed downward by an intermediate portion between the first notch 620 and the second notch 630 of the slider 600 as can be seen from FIGS. 27, 29, and 31. In other words, the intermediate portion between the first notch 620 and the second notch 630 of the slider 600 serves as a downward pusher 640 operable to push the engagement portion 320" downward. If the slider 600 is further pushed into the housing 220" along the X-direction, the engagement portion 320" is moved upward by a restoring force of the lock arm 310" when the engagement portion 320" reaches the second notch 630 as shown in FIG. 32. Thus, the engagement portion 320" is located within the second notch 630. At that time, the engagement portion 320" located within the second notch 630 prevents the slider 600 from coming off. In other words, the second notch 630 also has the same function as the stopper in the first and second embodiments. Furthermore, with the above configuration, if the slider 600 is pushed into the housing 220" until the engagement portion 320" is located within the second notch 630 when the second connector 200" is tentatively mated with the first connector 100", then the guide projections 114" are guided by the cam portions 610 and the guide portions 224 as described above. Then the first connector 100" and the second connector 200" are brought into a mating state. As can be seen from the above explanation, the fact that the engagement portion 320" is located within the second notch 630 means that a mating operation has been completed, i.e., the first connector 100" and the second connector 200" have been mated with each other.

As can be seen from comparison of FIGS. 28 and 20, the short-circuit member 700 of this embodiment has the same structure as the short-circuit member 500 of the second embodiment while it slightly differs in shape and location of the pressure receiver. Specifically, as shown in FIG. 28, the short-circuit member 700 includes a base portion 710 held by the housing 220", a first arm 720 for elastically supporting a first contact 722, and a second arm 730 for elastically supporting a second contact 732. The first arm 720 has a pressure receiver 724, which is pressed by the lock arm 310" being elastically deformed. The pressure receiver 724 elastically deforms the first arm 720 according to elastic deformation of the lock arm 310" and moves the first contact 722 mainly along the Z-direction on the YZ-plane. On the other hand, the second arm 730 has no pressure receiver. The second contact 732 can move separately from and independently of elastic deformation of the lock arm 310".

Figure 33:
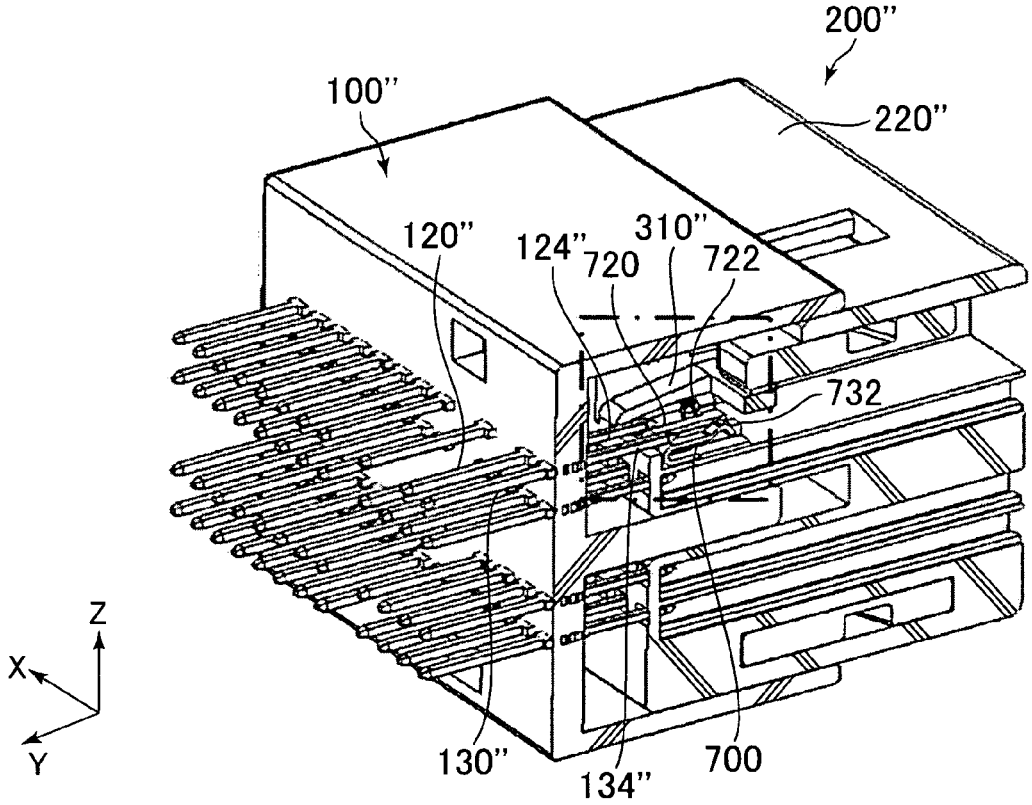
FIG. 33 is a perspective view including a cross-section near a short-circuit member of the connector assembly of FIG. 25. The second connector is being mated with the first connector.
Figure 34:
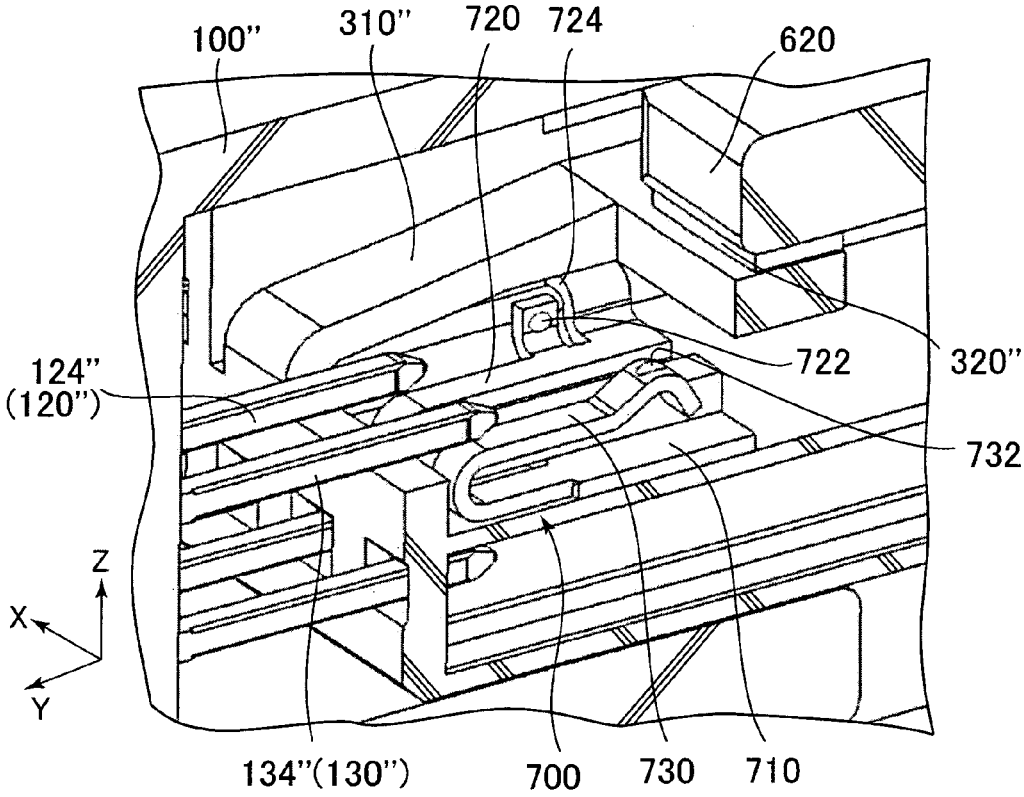
FIG. 34 is an enlarged perspective view partially showing the vicinity of the short-circuit member of the connector assembly of FIG. 33.

When a mating operation is performed using the slider 600, the first contacting section 124" of the first terminal 120" and the second contacting section 134" of the second terminal 130" are moved onto the short-circuit member 700 along the Y-direction as shown in FIGS. 33 and 34. At that time, as can be seen from FIG. 35, the second contact 732 is elastically supported by the second arm 730 so as to be positioned on a movement path of the second contacting section 134". Therefore, the second contact 732 is slid on a lower surface 134"*b* of the second contacting section 134" when the second contacting section 134" is inserted along the Y-direction. Thus, the lower surface 134"*b* of the second contacting section 134" is wiped by the second contact 732. On the other hand, the first contact 722 is moved mainly along the Z-direction on the YZ-plane via the pressure receiver 724 and the first arm 720 by the lock arm 310" that is elastically deformed by the slider 600. As shown in FIG. 35, in consideration of the fact that the first contact 722 is in contact with a side surface 124"*s* of the first contacting section 124" when the second connector 200" is mated with the first connector 100", it can be seen that the first contact 722 wipes the side surface 124"*s* of the first contacting section 124" at the time of operation of the slider 600.

Thus, in either of the embodiments, two contacts provided on a short-circuit member are separately controlled in movement. Therefore, the detection mechanism can have a wiping function without any problems that would be caused in the prior art.

In the present invention, a short-circuit member is brought into contact with two terminals in different methods. Specifically, a contact of the short-circuit member is moved in cooperation with elastic deformation of an elastic support (lock arm), so that the short-circuit member is brought into contact with one of the terminals. Another contact of the short-circuit member is brought into contact with the other terminal by movement that is independent of elastic deformation (e.g., mating operation itself). With such configuration, no insertion force is required to insert the short-circuit member between the terminals (cf. Patent Documents 4 and 5). Thus, according to the present invention, terminals of a detection mechanism can be wiped while a mating maintenance mechanism properly functions.

The present application is based on a Japanese patent application of JP2009-171594 filed before the Japan Patent Office on Jul. 22, 2009, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising a first connector, a second connector matable with the first connector along a mating direction, a mating assistance mechanism, a mating maintenance mechanism, and a detection mechanism, wherein the mating assistance mechanism has an operation member and is operable to mate the second connector with the first connector in accordance with an operation of the operation member, wherein the mating maintenance mechanism includes a stopper, an engagement portion and an elastic support, wherein the engagement portion is configured to be engaged with the stopper in a mating state of the first connector and the second connector so as to maintain the mating state, wherein the elastic support is configured to support the engagement portion, the elastic support being elastically deformed and moving the engagement portion along a direction different from the mating direction when the second connector is mated with the first connector, wherein the detection mechanism is operable to detect the mating state and includes a first terminal, a second terminal, and a short-circuit member, wherein the first terminal has a first contacting section extending along the mating direction, wherein the second terminal has a second contacting section extending along the mating direction, and wherein the short-circuit member is arranged to establish a short circuit between the first terminal and the second terminal in the mating state, the short-circuit member having a first contact and a second contact which are brought into contact with the first contacting section and the second contacting section in the mating state, respectively, the first contact being directly/indirectly moved by movement and elastic deformation of the elastic support so that the first contact wipes the first contacting section during a mating operation of the first connector and the second connector, the second contact wiping the second contacting section independently of the elastic deformation of the elastic support during the mating operation.

2. The connector assembly according to claim 1, wherein the second contact is configured to be slidable on the second contacting section along the mating direction during the mating operation to wipe the second contacting section.

3. The connector assembly according to claim 1, wherein each of the first contacting section and the second contacting section has a rectangular cross-section on a plane perpendicular to the mating direction, wherein the first contacting section and the second contacting section are arranged in a vertical direction perpendicular to the mating direction, and wherein the first contact and the second contact are configured to wipe side surfaces of the first contacting section and the second contacting section, respectively.

4. The connector assembly according to claim 3, wherein the short-circuit member includes a first arm elastically supporting the first contact and a second arm elastically supporting the second contact, wherein the first arm has a pressure receiver portion pressed by the elastic support when the elastic support is elastically deformed, and wherein the first contact is moved on a horizontal plane perpendicular to the vertical direction when the pressure receiver portion is pressed by the elastic support.

5. The connector assembly according to claim 3, wherein the second connector has a housing, wherein the operation member comprises a lever provided on the second connector, the lever being rotatable on a horizontal plane parallel to the mating direction, wherein the mating assistance mechanism is configured to mate the second connector with the first connector by rotating the lever when the second connector is tentatively mated with the first connector, wherein the stopper is provided on the second connector, wherein the engagement portion and the elastic support are formed integrally with the lever, and wherein the short-circuit member is held by the housing.

6. The connector assembly according to claim 5, wherein the pressure receiver portion includes a first pressure receiver and a second pressure receiver, wherein the elastic support includes a first presser and a second presser, wherein the first presser is operable to press the first pressure receiver and moves the first contact away from the first contacting section during only a first period that is part of the operation of rotating the lever, wherein the second presser is operable to press the second pressure receiver and moves the first contact away from the first contacting section during only a second period that is part of the operation of rotating the lever and partially overlaps the first period, and wherein the first contact is brought into contact with the first contacting section when the engagement portion engages with the stopper after the second presser presses the second pressure receiver.

7. The connector assembly according to claim 6, wherein the each of the first presser and the second presser has an island shape projecting from the elastic support in the vertical direction, wherein the second presser is located closer to the engagement portion as compared to the first presser, wherein the short-circuit member further includes a first support and a second support, the second support extending from the first arm on a horizontal plane parallel to the mating direction, wherein the first pressure receiver and the second pressure receiver are elastically supported by the first support and the second support, respectively, wherein the first pressure receiver is located closer to a mating portion of the second connector and the first connector as compared to the second pressure receiver, wherein the first presser is configured to move in a first path according to rotation of the lever during the mating operation, the first path is a path in accordance with which the first presser passes between the second pressure receiver and the first arm, press the first pressure receiver on the horizontal plane and then move away from the first pressure receiver, and wherein the second presser is configured to move in a second path similar to a path of the engagement portion, the second path is a path in accordance with which the second presser starts to press the second pressure receiver before the first presser separates from the first pressure receiver.

8. The connector assembly according to claim 6, further comprising a movement mechanism operable to temporarily move the second pressure receiver in the vertical direction until the engagement portion engages with the stopper when the second presser presses the second pressure receiver, wherein the first contact is moved from an initial vertical position along the vertical direction in response to movement of the second pressure receiver in the vertical direction and is then moved back to the initial position when the engagement portion engages with the stopper so that the first contact wipes the first contacting section.

9. The connector assembly according to claim 1, wherein each of the first contacting section and the second contacting section has a rectangular cross-section on a plane perpendicular to the mating direction, wherein the first contacting section and the second contacting section are arranged in a horizontal direction perpendicular to the mating direction, wherein the first contact is configured to wipe a side surface of the first contacting section, and wherein the second contact is configured to wipe a lower surface or an upper surface of the second contacting section.

10. The connector assembly according to claim 9, wherein the elastic support supports the engagement portion so that the engagement portion is movable on a vertical plane perpendicular to the horizontal direction, wherein the short-circuit member includes a first arm elastically supporting the first contact and a second arm elastically supporting the second contact, wherein the first arm has a pressure receiver portion pressed by the elastic support during the elastic support is elastically deformed, and wherein the first contact is moved on the vertical plane when the pressure receiver portion is pressed by the elastic support.

11. The connector assembly according to claim 9, wherein the operation member comprises a lever provided on the second connector, the lever being rotatable on a horizontal plane parallel to the mating direction, wherein the mating assistance mechanism is configured to mate the second connector with the first connector by rotating the lever when the second connector is tentatively mated with the first connector, wherein the stopper is provided on the second connector, wherein the engagement portion and the elastic support are formed integrally with the lever, and wherein the short-circuit member is held by the lever.

12. The connector assembly as recited in claim 9, wherein the second connector has a housing, wherein the operation member comprises a slider which is held on the housing so as to be movable on a horizontal plane perpendicular to the mating direction, wherein the mating assistance mechanism is configured to mate the second connector with the first connector by moving the slider when the second connector is tentatively mated with the first connector, wherein the stopper is provided on the slider, wherein the engagement portion and the elastic support are provided on the housing, and wherein the short-circuit member is held by the housing.

13. The connector assembly as recited in claim 1, wherein the first contact is configured to wipe the first contacting section along a vertical direction perpendicular to the mating direction.

* * * * *